US010344494B2

(12) United States Patent
Volin

(10) Patent No.: US 10,344,494 B2
(45) Date of Patent: Jul. 9, 2019

(54) ROTATABLE ROLLABLE LOCKABLE COLLAPSIBLE EXPANDABLE CARPORT

(71) Applicant: Dee Volin, Fairview, OR (US)

(72) Inventor: Dee Volin, Fairview, OR (US)

( * ) Notice: Subject to any disclaimer, the term of this patent is extended or adjusted under 35 U.S.C. 154(b) by 297 days.

(21) Appl. No.: 15/469,549

(22) Filed: Mar. 26, 2017

(65) Prior Publication Data

US 2017/0284117 A1 Oct. 5, 2017

Related U.S. Application Data

(60) Provisional application No. 62/316,967, filed on Apr. 1, 2016.

(51) Int. Cl.

| | |
|---|---|
| ***E04H 6/04*** | (2006.01) |
| ***E04H 15/46*** | (2006.01) |
| ***E04H 15/48*** | (2006.01) |
| ***E04H 15/64*** | (2006.01) |
| *E04H 15/18* | (2006.01) |
| *E04B 1/343* | (2006.01) |

(52) U.S. Cl.

CPC ..... *E04H 6/04* (2013.01); *E04H 15/46* (2013.01); *E04H 15/48* (2013.01); *E04H 15/64* (2013.01); *E04B 1/34305* (2013.01); *E04B 1/34315* (2013.01); *E04H 15/18* (2013.01)

(58) Field of Classification Search

CPC ..... E04H 15/18; E04H 15/34; E04H 15/44; E04H 6/025; E04H 6/04; E04B 1/343; E04B 1/34305; E04B 1/34315

USPC ..... 135/912, 906, 909, 97; 52/869, 73, 63, 52/222

See application file for complete search history.

(56) References Cited

U.S. PATENT DOCUMENTS 2,757,677 A * 8/1956 Denn ..... B23K 1/00 135/160
2,889,840 A * 6/1959 McIlwaine ..... E04F 10/02 135/119

(Continued)

FOREIGN PATENT DOCUMENTS

FR 360204 A * 4/1906 ..... E04H 15/34

*Primary Examiner* — David R Dunn
*Assistant Examiner* — Danielle Jackson

(57) ABSTRACT

An 11-device-in-one system (which can be used as 360-degree-rotatable rollable portable lockable collapsible expandable carport, green house, gazebo, storage, attic, awnings, tent, workshop, outdoor tables, booth, and RV port) comprises: round bars; square bars releasably attached to the round bars; 360-degree rotatable lockable wheels rotatably attached to the round bars; canvas roof panels; canvas side panels; canvas end panels; canvas gap-covering panels; panel-lifting VELCRO (hook and loop fasteners) sewn to the side and gap-covering panels; panel-sealing zippers sewn to the end panels (for forming doors); panel-sealing grommets attached to the roof, side, and end panels; bungee cords and balls inserted through the grommets (for attaching the roof, side, and end panels together); first telescopic arms foldably and releasably attached to the round bars; second telescopic arms foldably attached to the first telescopic arms; feet welded to the second telescopic arms (for attaching to each other over the roof panels to form the frames for booth signs); and toes welded to the round bars (for releasably locking the feet thereon to form the frames for awnings and tables).

20 Claims, 18 Drawing Sheets

(56) References Cited

U.S. PATENT DOCUMENTS 3,536,083 A * 10/1970 Reynolds ..... E04H 15/324 135/117
4,347,690 A 9/1982 Wallace, Jr.
4,404,980 A 9/1983 Wade
4,769,962 A * 9/1988 Pohl ..... E04B 1/34326 135/160
4,944,321 A 7/1990 Moyet-Ortiz
5,595,203 A 1/1997 Espinosa
5,700,102 A * 12/1997 Feleppa ..... A47B 47/0016 403/170
5,709,238 A * 1/1998 Mattioli ..... E04H 15/34 135/114
D403,782 S 1/1999 James
5,857,477 A 1/1999 James
6,155,280 A * 12/2000 Powell ..... E04H 15/18 135/119
6,289,909 B1 9/2001 Wood
6,341,541 B1 1/2002 Morton, Sr.
6,374,843 B1 4/2002 Zou
6,434,895 B1 8/2002 Hosterman
6,763,633 B2 7/2004 Cote
6,892,503 B1 * 5/2005 Kang ..... E04H 15/34 403/170
6,994,099 B2 * 2/2006 Goldwitz ..... E04H 15/322 135/115
7,152,614 B2 12/2006 Kalnay
7,216,658 B1 5/2007 Navarro
7,275,555 B2 10/2007 Powell
7,604,016 B2 10/2009 Songest
8,267,106 B2 9/2012 Jordache
8,453,664 B2 6/2013 Parsons
8,522,806 B2 9/2013 Li
8,746,267 B2 6/2014 Lovely, II
9,016,299 B2 4/2015 Carter
9,090,197 B2 7/2015 Pierce
9,103,137 B2 8/2015 Williams
9,163,394 B1 10/2015 Barker
9,187,924 B1 11/2015 Jackson
2005/0194030 A1 * 9/2005 Goldwitz ..... E04H 15/34 135/121
2007/0094947 A1 * 5/2007 Greenfeld ..... E04H 6/04 52/79.1
2010/0154853 A1 * 6/2010 Tseng ..... E04H 15/44 135/122
2012/0000499 A1 * 1/2012 Li ..... E04H 15/16 135/122
2013/0276382 A1 * 10/2013 Workman ..... E04H 15/44 52/63
2014/0020727 A1 1/2014 Kayser
2015/0136191 A1 * 5/2015 Carbaugh ..... E04B 1/3441 135/120.3

* cited by examiner

ROTATABLE ROLLABLE LOCKABLE COLLAPSIBLE EXPANDABLE CARPORT

REFERENCE TO PREVIOUSLY FILED PROVISIONAL PATENT APPLICATION

Provisional Patent Application No. 62/316,967 was filed on Apr. 1, 2016.

1. FIELD OF THE INVENTION

The present invention relates to a collapsible carport, which is cheap to produce, is easy to ship as one unit, can quickly and easily be assembled and disassembled, and can quickly and easily be folded and unfolded. Particularly, the present invention relates to a unique 11-device-in-one system, comprising:

1) 360-degree-rotatable rollable portable lockable collapsible expandable carport,
2) 360-degree-rotatable rollable portable lockable collapsible expandable green house,
3) 360-degree-rotatable rollable portable lockable collapsible expandable gazebo,
4) 360-degree-rotatable rollable portable lockable collapsible expandable storage,
5) 360-degree-rotatable rollable portable lockable collapsible expandable attic,
6) 360-degree-rotatable rollable portable lockable collapsible expandable awning,
7) 360-degree-rotatable rollable portable lockable collapsible expandable tent (for Camping/Exhibition),
8) 360-degree-rotatable rollable portable lockable collapsible expandable workshop with built-in tables (for functioning as car-and-boat body shop and car-and-boat-repairing shop),
9) 360-degree-rotatable rollable portable lockable collapsible expandable outdoor party and work tables,
10) 360-degree-rotatable rollable portable lockable collapsible expandable booth with built-in boot-sign frames, and
11) 360-degree-rotatable rollable portable lockable collapsible expandable RV port.

2. DESCRIPTION OF THE PRIOR ART

A number of collapsible carports have been introduced.

U.S. Pat. No. 4,404,980, issued 1983 Sep. 7, to Mark W. Wade, describes a covered structure is formed in an arched shape and utilizes PVC pipe which is slidable through sleeves electrically welded to a cover. The PVC pipe is bent into an arched shape and is attached to spreader bars, which serve as the ground contacting portion of the structure. Fiberglass rods are inserted within the arched PVC pipe so as to both strengthen and define the arch, and water bags and stakes may be attached to the spreader bar, which is also constructed of PVC pipe, so as to anchor the structure to the ground.

U.S. Pat. No. 4,347,690, issued 1982 Sep. 7, to Brenton G. Wallace Jr., describes a skeletal framework structure which employs a special junction for securing together the ends of the framework members, the ends of one pair of which members have longitudinal axes lying in a common plane while the axes of others of the members extend at angles to that plane. The framework members having axes lying in the same plane may be parts of straight tubular arch members in the framework, while the framework members extending at an angle to that plane may constitute spacer members, or purlins, extending perpendicular to the plane of the arch members, or may constitute diagonal bracing members extending at other angles to the plane of the arch members.

U.S. Pat. No. 4,944,321, issued 1990 Jul. 31, to Francisco Moyet-Ortiz, describes a combination portable vehicle garage and tent structure incorporating support members which in the garage mode are retained under the wheels of the vehicle which support members have a framework of support poles and cross members with a cover to shelter the vehicle which structure, when a vehicle is not positioned therein, can be utilized as a tent.

U.S. Pat. No. 5,595,203, issued 1997 Jan. 21, to Mark A. Espinosa, describes a portable stressed arch structure is constructed by assembling an essentially flat, planar frame of straight, uncurved components, and then drawing two opposite sides together and securing them with tension cables to hold the frame in an arch configuration. The arched framework is then covered with a conventional tarp or the like, as desired.

U.S. Pat. No. 5,857,477, issued 1999 Jan. 12, to Michael James, details a portable carport having a frame, a flexible fabric cover, and mechanisms for attaching the frame to the outsides of the wheels of an automobile. Because the frame is secured to the outsides of the wheels rather than beneath the wheels, the frame can be easily attached to the automobile after the automobile is parked. The frame is adjustable for height, width, and length, and can be adapted to cover as much of the car as desired.

U.S. Pat. No. 6,289,909 issued 2001 Sep. 18, to Thomas James Wood, describes a mobile stressed arched shelter in the form of a tunnel that stands freely. The shelter is assembled by bending straight pipes to opposite sides of two parallel base legs. The base legs are held together by flat straps and are covered by a tarp. Openings and closings at each end of the shelter utilize folds in the tarp.

U.S. Pat. No. 6,341,451 issued 2002 Jan. 29, to Dudley Morton Sr., refers to a portable garage apparatus for providing shelter to a vehicle for people who don't have a garage. The portable garage apparatus includes a portable building structure having a floor, a top wall, side walls, an opening in a back end thereof, and an opening in a front end thereof; and also includes a plurality of doors securely attached to the building structure;

U.S. Pat. No. 6,374,843 issued 2002 Apr. 23, to Yinong Zou, describes a support structure for a collapsible shelter, includes legs and upper beams hinged together. Each upper beam is composed of two component rods connected with each other by a freely swinging hinge. Each leg has a sliding part thereon. There is provided an upper or upward stay bar between the sliding part on each leg and the component rods of the upper beam respectively.

U.S. Pat. No. 6,434,895 issued 2002 Aug. 20, to Craig Hosterman, D. L. Bennett, describes a folded building, after having been trailered on its own wheel assemblies to a site, is unfolded at the site by first reorienting 90.degree. The wheel assemblies attached to each of a pair of side walls and removing an attached trailer hitch. The side walls are drawn apart from one another while having supported by the rolling wheel assemblies.

U.S. Pat. No. 6,763,633 issued 2004 Jul. 20, to Roger Cote, describes a portable enclosure for temporary shelter purposes as a storage building or workshop at remote construction sites comprises a plurality of articulable frames mounted on a towable boom, which may be coupled to a towing tractor, and which has wheels at the other end so that it may be towed.

U.S. Pat. No. 7,152,614 issued 2006 Dec. 26, to Peter A. Kalnay, demonstrates a foldable, deployable framework for a structure has a lower hub having a first central axis, sets of tracks, masts, and rafters connected pivotally to the lower hub, to one another, and to an upper hub in a manner that allows the framework to be folded into one, two or three small packages, and to be deployed into a structural frame supporting floors, walls, and roof for an enclosed structure.

U.S. Pat. No. 7,216,658 issued 2007 May 15, to Arthur Navarro, describes an apparatus for a portable pop-up carport for automobiles 18, sports utility vehicles and small trucks comprising a foldable frame structure 32 having a light weight waterproof roof 20, side panels of mesh-like material 22 and optional front and rear panels.

U.S. Pat. No. 7,275,555 issued 2007 Oct. 2, to Billy R. Powell, describes a canopy of the type that is typically packaged in a kit form that permits consumers to assemble a group of pipe members into a canopy structure. Once assembled and erected, the canopy includes a series of vertical posts and a series of rafters that extend upwardly from the post.

U.S. Pat. No. 7,604,016 issued 2009 Oct. 20, to Anthony D. Songest, reveals a portable vehicle cover (10) includes a base frame (12) and a plurality of transversely extending hoop members (14). Each hoop member is adapted to be releasably connectable with the frame such that at least two of the hoop members substantially extend diagonally across the frame in a cruciform orientation. A flexible cover (16) is engagable with the hoop members to form a weather shield for a vehicle.

U.S. Pat. No. 8,220,477 issued 2012 Jul. 17, to Lindy Park, describes a collapsible canopy frame having an improved roof and support structure. A collapsible canopy frame according to one embodiment includes a plurality of side poles; a plurality of edge scissor assemblies coupling adjacent side poles of the plurality of side poles to one another; a center pole for supporting a covering; a plurality of center pole ribs each coupling the center pole to a respective side pole of the plurality of side poles; and a plurality of center scissor assemblies coupling the plurality of edge scissor assemblies to the center pole.

U.S. Pat. No. 8,267,106 issued 2012 Sep. 18, to Ronald Jordache, describes a shelter for a motor vehicle or other movable object is moved from a fully retracted position to a fully deployed position by a combination of linear and pivotal movement. The shelter includes a frame assembly including parallel rails with pole holding subassemblies mounted on and movable along the rails.

U.S. Pat. No. 8,453,664 issued 2013 Jun. 4, to William Parsons, demonstrates a portable shelter may be provided with ground assembly, flex poles, and a cover assembly. The ground assembly may include a ground sheet or pad having rigid elements, such as metal ground poles along opposite sides. The ground poles may extend through sleeves on the ground sheet.

U.S. Pat. No. 8,522,806 issued 2013 Sep. 3, to Wanda Ying Li, demonstrates an outdoor canopy which includes a canopy frame, a canopy shelter and a side entrance arrangement. The canopy frame includes a roof frame and a legs frame downwardly extended from the roof frame to form a canopy area. The canopy shelter is waterproof and is detachably fastening at the canopy frame to define a ceiling wall, a front wall, a rear wall and two sidewalls for enclosing the canopy area therewithin.

U.S. Pat. No. 8,746,267 issued 2014 Jun. 10, to Jack B. Lovley II, describes a canopy structure includes a plurality of support members, each including a first leg and a second leg telescopically slideable within the first leg to infinitely adjust a height of the canopy structure. The canopy structure can include a plurality of eaves including scissor-jack members moveable between an extended position and a collapsed position.

U.S. Pat. No. 9,016,299 issued 2015 Apr. 28, to Mark C. Carter, describes the quickly erectable dome shelter includes an extendible perimeter truss assembly with link members connected between adjacent legs, a central truss assembly of link members, and a roof framework, including pairs of curved upper and lower peak truss members, that is movable between a lowered, collapsed configuration and a raised, upwardly arching position.

U.S. Pat. No. 9,090,197 issued 2015 Jul. 28, to Skip A. Pierce, reveals a camping assembly is provided having a frame with a base and a superstructure, and a tent mounted on the frame superstructure, wherein the tent is configurable from a closed position for transport to an open position with the tent floor forming a cantilever relative to the frame.

U.S. Pat. No. 9,103,137 issued 2015 Aug. 11, to Marty Williams, defines a shelter system including a base assembly and a flexible support assembly where the base assembly has two legs that are held together by at least two tension straps and the where the flexible support assembly has flexible support members and spanning poles and where the flexible support members of the flexible support assembly are securely attached to the base assembly at each end of the base system legs and where the entire flexible support assembly is then erected and covered, creating a self standing shelter system.

U.S. Pat. No. 9,163,394 issued 2015 Oct. 20, to Richard Bruce Barker, depicts a portable or moveable carport is described. The carport as described herein is able to be quickly and easily set up and taken down while still shielding a vehicle from rain, snow and sun—the primary destroyers of automotive paint, body and interiors.

U.S. Pat. No. 9,187,924 issued 2015 Nov. 17, to Carlton Jackson, describes an anchoring system for a hoop house includes a horizontal member. The horizontal member includes an anchor connector and a hoop connector. An anchor can be removably affixed to the anchor connector of the horizontal member. The anchor can include an attachment member that defines a non-vertical passage, where a post member can be inserted into the non-vertical passage and driven into the ground at an angle.

U.S. Pat. No. D403,782 issued 1999 Jan. 5, to Michael James, depicts the ornamental design for a portable carport frame, as shown and described.

U.S. Patent No 20140020727 issued 2015 Mar. 17, to Matt Kayser, describes an erectable canopy framework comprising a base frame and a roof frame. The roof frame is operative to support a canopy above the base frame and is removably mountable to the base frame. The framework comprises a plurality of rafter fittings each adapted for insertion into a corresponding mount opening and connectable to a corresponding rafter.

DISADVANTAGES OF THE PRIOR ART

The prior art have failed to solve many problems associated with such collapsible carports, as follows:

1) No prior art mention or disclose any collapsible carport, having 11-device-in-one system.

Therefore, the prior art of collapsible carport:

a) Can not foldably and unfoldably transform into, a rollable, portable, lockable, collapsible carport (FIG. 6), a rollable, portable, lockable, collapsible gazebo (FIG. 8A),
a rollable, portable, lockable, collapsible storage space (FIG. 9),
a rollable, portable, lockable, collapsible greenhouses (FIG. 4A),
a rollable, portable, lockable, collapsible attic space (FIG. 9),
a rollable, portable, lockable, collapsible RV port (FIGS. 15A and 15B),
a rollable, portable, lockable, collapsible exhibition tent (FIG. 4A),
a rollable, portable, lockable, collapsible camping tent (FIGS. 8A and 8B),
a rollable, portable, lockable, collapsible automotive workshop (FIGS. 4A, 7, 10, and 11),
a rollable, portable, lockable, collapsible marine workshop (FIGS. 4A, 7, 10, and 11),
a rollable, portable, lockable, collapsible outdoor party space (FIGS. 4A, 7, 10, and 11), and
a rollable, portable, lockable, collapsible fair and trade-show booth having an adjustable foldable arm system swinging over the booth and forming a booth-sign frame (FIG. 14);

b) Can not interchange from 11 devices, to be economically used and multi-purposeful; and
c) Can not interchange from 11 devices to save materials, labor, time, space, and money.

2) No prior art mention or disclose any collapsible carport, having 11 shape-shifting capabilities.
Therefore, the prior art of collapsible carport:
a) Can not trap light and magnify properties, to convert the unique 11-device-in-one system into a greenhouse;
b) Can not optionally configure the panel system in conjunction with the adjustable foldable arm system, to form adjacent rooms on either side of the greenhouse;
c) Can not optionally configure the panel system in conjunction with the adjustable foldable arm system, to form adjacent rooms on either side of the camping tent; and
d) Can not combine with a vapor barrier in the attic to create a thermo insulating buffer, minimizing cold temperatures.

3) No prior art mention or disclose any collapsible carport, having an adjustable foldable arm system with unique feet and toes.
Therefore, the prior art of collapsible carport:
a) Can not expand and fold instantly to put away for self storage or for transport;
b) Can not allow quick and easy conversion from use as an auxiliary room or storage space to a storage shelf;
c) Can not allow quick and easy conversion from use as an auxiliary room or storage space to an awning; and
d) Can not allow quick and easy conversion from use as an auxiliary room or storage space to a table.

4) No prior art mention or disclose any collapsible carport, having an adjustable foldable arm system with unique feet and toes.
Therefore, the prior art of collapsible carport:
a) Can not allow quick and easy conversion from use as an auxiliary room or storage room to a food preparation and serving space;
b) Can not allow quick and easy conversion from use as an auxiliary room or storage room to a retail display shelving space;
c) Can not allow quick and easy conversion from use as an auxiliary room or storage space to a product display, and sales space;
d) Can not allow quick and easy conversion from use as an auxiliary room or storage space to a beverage preparation, display, and sales area;
e) Can not allow quick and easy conversion from use as an auxiliary room or storage space to a workspace for group processing; and
f) Can not allow quick and easy conversion from use as an auxiliary room or storage space to a table for food preparation, serving, and dining space.

5) No prior art mention or disclose any collapsible carport, having unique feet, toes, and 360-degree rotatable lockable wheels.
Therefore, the prior art of collapsible carport:
a) Can not transfer the 11-device-in-one system, to be implanted on grass, asphalt parking lot and gravel outdoor areas;
b) Can not transfer the 11-device-in-one system, to be implanted on tile, hardwood, carpet and linoleum indoor areas;
c) Can not accommodate multiple positions to allow use in multiple locations; and
d) Can not lockingly be positioned in one place, to securely remain in a desired location.

6) No prior art mention or disclose any collapsible carport, having unique feet and toes.
Therefore, the prior art of collapsible carport:
a) Can not interlock with the u-shaped foot-toe connectors, to create a secure gravitational force enhanced connection of the awning material;
b) Can not interlock with the u-shaped foot-toe connectors, to create a secure gravitational force enhanced connection of the table material;
c) Can not interlock with the u-shaped foot-toe connectors, to create a secure gravitational force enhanced connection of the shelving material; and
d) Can not securely interlock the u-shaped foot-toe connectors, to overcome typical horizontal forces from wind and operational movement.

7) No prior art mention or disclose any collapsible carport, having U-shaped foot-toe connectors and L-shaped telescopic-arm joints.
Therefore, the prior art of collapsible carport:
a) Can not adapt an extendable collapsible frame system to a side panel and end panel, to become an open-air gazebo with roof only;
b) Can not adapt an extendable collapsible frame system to a side panel and end panel, to become a three-walled gazebo;
c) Can not adapt an extendable collapsible frame system to a side panel and end panel, to become a two-walled gazebo;

d) Can not adapt an extendable collapsible frame system to a side panel and end panel,
to become a single-walled gazebo for privacy; and e) Can not adapt an extendable collapsible frame system to a side panel and end panel,
to become a walk-through two-sided walled gazebo.

8) No prior art mention or disclose any collapsible carport, having U-shaped foot-toe connectors and L-shaped telescopic-arm joints.

Therefore, the prior art of collapsible carport:

a) Can not securely hang retail products,
to be used as retail display;

b) Can not securely hang retail products,
to be used in place of shelving;

c) Can not securely hang vegetation;
to be used with greenhouse configuration; and d) Can not securely hang lights,
to be used as lighting display.

OBJECTS AND ADVANTAGES OF THE INVENTION

The present invention substantially departs from the conventional concepts and designs of the prior art. In doing so, the present invention provides a unique 11-device-in-one system having many unique and significant features, functions, and advantages, which overcome all the disadvantages of the prior art, as follows:

1) It is an object of the new invention to provide a unique 11-device-in-one system,
having 11-device-in-one system.

Therefore, the unique 11-device-in-one system:

a) Can foldably and unfoldably transform into,
a rollable, portable, lockable, collapsible carport (FIG. 6),
a rollable, portable, lockable, collapsible gazebo (FIG. 8A),
a rollable, portable, lockable, collapsible storage space (FIG. 9),
a rollable, portable, lockable, collapsible greenhouses (FIG. 4A),
a rollable, portable, lockable, collapsible attic space (FIG. 9),
a rollable, portable, lockable, collapsible RV port (FIGS. 15A and 15B),
a rollable, portable, lockable, collapsible exhibition tent (FIG. 4A),
a rollable, portable, lockable, collapsible camping tent (FIGS. 8A and 8B),
a rollable, portable, lockable, collapsible automotive workshop (FIGS. 4A, 7, 10, and 11),
a rollable, portable, lockable, collapsible marine workshop (FIGS. 4A, 7, 10, and 11),
a rollable, portable, lockable, collapsible outdoor party space (FIGS. 4A, 7, 10, and 11), and
a rollable, portable, lockable, collapsible fair and tradeshow booth having an adjustable foldable arm system swinging over the booth and forming a booth-sign frame (FIG. 14);

b) Can interchange from 11 devices,
to be economically used and multi-purposeful; and c) Can interchange from 11 devices
to save materials, labor, time, space, and money.

2) It is another object of the new invention to provide a unique 11-device-in-one system,
having 11 shape-shifting capabilities.

Therefore, the unique 11-device-in-one system:

a) Can trap light and magnify properties,
to convert the unique 11-device-in-one system into a greenhouse;

b) Can optionally configure the panel system in conjunction with the adjustable foldable arm system,
to form adjacent rooms on either side of the greenhouse;

c) Can optionally configure the panel system in conjunction with the adjustable foldable arm system,
to form adjacent rooms on either side of the camping tent; and d) Can combine with a vapor barrier in the attic
to create a thermo insulating buffer, minimizing cold temperatures.

3) It is still another object of the new invention to provide a unique 11-device-in-one system,
having an adjustable foldable arm system with unique feet and toes.

Therefore, the unique 11-device-in-one system:

a) Can expand and fold instantly
to put away for self storage or when collapsing for transport;

b) Can allow quick and easy conversion from use as an auxiliary room or storage space,
to a storage shelf;

c) Can allow quick and easy conversion from use as an auxiliary room or storage space,
to an awning; and d) Can allow quick and easy conversion from use as an auxiliary room or storage space,
to a table.

4) It is a further object of the new invention to provide a unique 11-device-in-one system,
having an adjustable foldable arm system with unique feet and toes.

Therefore, the unique 11-device-in-one system:

a) Can allow quick and easy conversion from use as an auxiliary room or storage room
to a food preparation and serving space;

b) Can allow quick and easy conversion from use as an auxiliary room or storage room,
to a retail display shelving space;

c) Can allow quick and easy conversion from use as an auxiliary room or storage space,
to a product display and sales space;

d) Can allow quick and easy conversion from use as an auxiliary room or storage space,
to a beverage preparation, display, and sales area;

e) Can allow quick and easy conversion from use as an auxiliary room or storage space,
to a workspace for group processing; and f) Can allow quick and easy conversion from use as an auxiliary room or storage space,
to a table for food preparation, serving, and dining space.

5) It is an even further object of the new invention to provide a unique 11-device-in-one system,
having unique feet, toes, and 360-degree rotatable lockable wheels.

Therefore, the unique 11-device-in-one system:

a) Can transfer the 11-device-in-one system,
to be implanted on grass, asphalt parking lot and gravel outdoor areas;

b) Can transfer the 11-device-in-one system,
to be implanted on tile, hardwood, carpet and linoleum indoor areas;
c) Can accommodate multiple positions
to allow use in multiple locations; and
d) Can lockingly be positioned in one place,
to securely remain in a desired location.

6) It is still another object of the new invention to provide a unique 11-device-in-one system,
having unique feet and toes.
Therefore, the unique 11-device-in-one system:
a) Can interlock with the u-shaped foot-toe connectors,
to create a secure gravitational-force-enhanced connection of the awning material;
b) Can interlock with the u-shaped foot-toe connectors,
to create a secure gravitational-force-enhanced connection of the table material;
c) Can interlock with the u-shaped foot-toe connectors,
to create a secure gravitational-force-enhanced connection of the shelving material; and
d) Can securely interlock the u-shaped foot-toe connectors,
to overcome typical horizontal forces from wind and operational movement.

7) It is yet another object of the new invention to provide a unique 11-device-in-one system,
having U-shaped foot-toe connectors and L-shaped telescopic-arm joints.
Therefore, the unique 11-device-in-one system:
a) Can adapt an extendable collapsible frame system to a side panel and end panel,
to become an open-air gazebo with roof only;
b) Can adapt an extendable collapsible frame system to a side panel and end panel,
to become a three-walled gazebo;
c) Can adapt an extendable collapsible frame system to a side panel and end panel,
to become a two-walled gazebo;
d) Can adapt an extendable collapsible frame system to a side panel and end panel,
to become a single-walled gazebo for privacy; and
e) Can adapt an extendable collapsible frame system to a side panel and end panel,
to become a walk-through two-sided walled gazebo.

8) It is still yet another object of the new invention to provide a unique 11-device-in-one system,
having U-shaped foot-toe connectors and L-shaped telescopic-arm joints.
Therefore, the unique 11-device-in-one system:
a) Can securely hang retail products,
to be used as retail display;
b) Can securely hang retail products,
to be used in place of shelving;
c) Can securely hang vegetation;
to be used with greenhouse configuration; and
d) Can securely hang lights,
to be used as lighting display.

Other objects and advantages of the present invention will become apparent from a consideration of the accompanying drawings and ensuing description.

BRIEF DESCRIPTION OF THE DRAWINGS

Figure

SUMMARY OF THE INVENTION

Figure 1A:
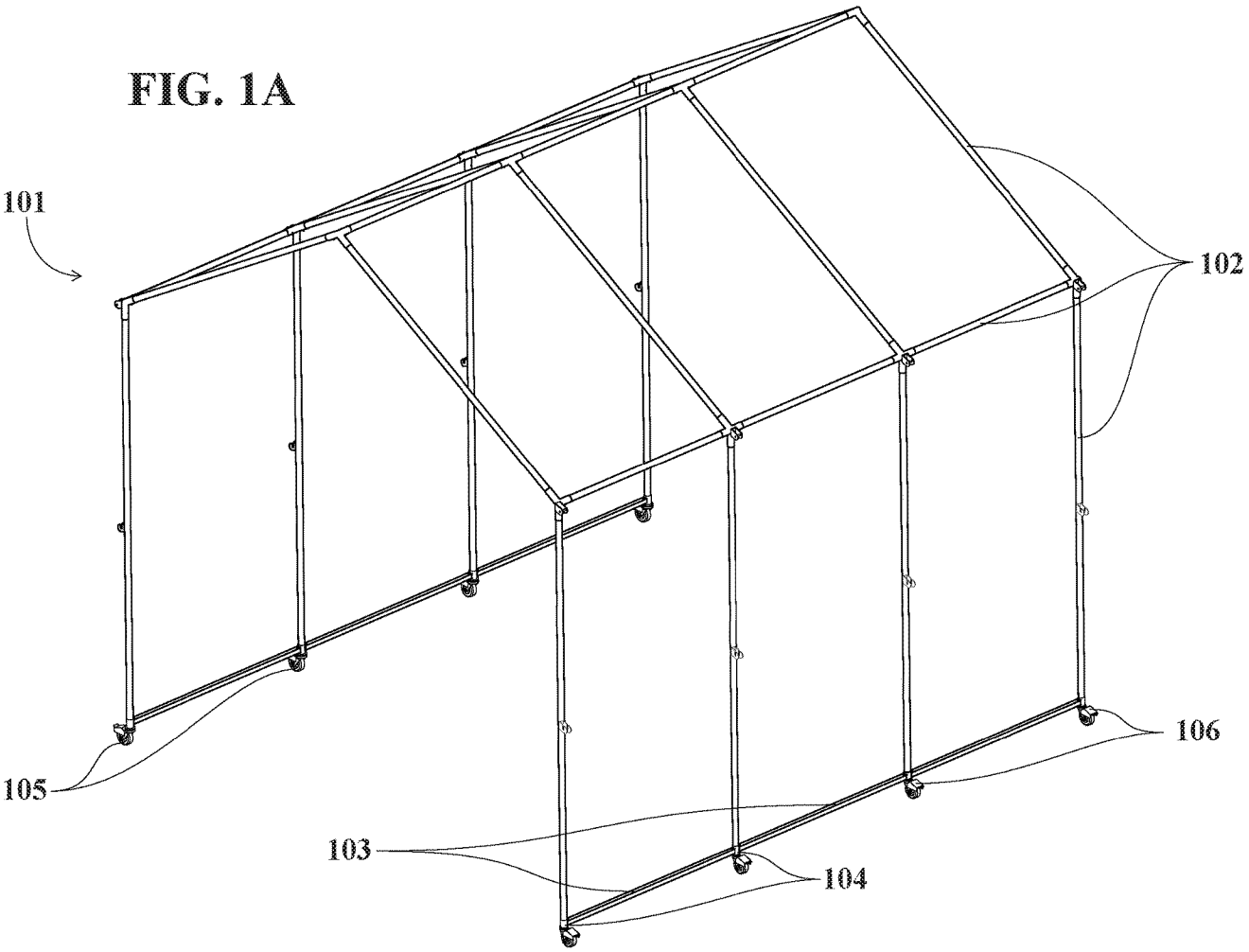
FIG. 1A illustrates a perspective view of a unique 11-device-in-one system (of 360-degree rotatable rollable portable lockable collapsible expandable carport, green house, gazebo, storage, attic, awning, tent, workshop, outdoor table, booth, and RV port).

An 11-device-in-one system (which can be used as 360-degree rotatable rollable portable lockable collapsible expandable carport, green house, gazebo, storage, attic, awnings, tent, workshop, outdoor tables, booth, and RV port) comprises: round bars; square bars releasably attached to the round bars; 360-degree rotatable lockable wheels rotatably attached to the round bars; canvas roof panels; canvas side panels; canvas end panels; canvas gap-covering panels; panel-lifting VELCRO (hook and loop fasteners) sewn to the side and gap-covering panels; panel-sealing zippers sewn to the end panels (for forming doors); panel-sealing grommets attached to the roof, side, and end panels; bungee cords and balls inserted through the grommets (for attaching the roof, side, and end panels together); first telescopic arms foldably and releasably attached to the round bars; second telescopic arms foldably attached to the first telescopic arms; feet welded to the second telescopic arms (for attaching to each other over the roof panels to form the frames for booth signs); and toes welded to the round bars (for releasably locking the feet thereon to form the frames for awnings and tables).

DETAILED DESCRIPTION OF THE INVENTION

Component

A unique 11-device-in-one system comprises:

1) 360-degree-rotatable rollable portable lockable collapsible expandable carport,
2) 360-degree-rotatable rollable portable lockable collapsible expandable green house,
3) 360-degree-rotatable rollable portable lockable collapsible expandable gazebo,
4) 360-degree-rotatable rollable portable lockable collapsible expandable storage,
5) 360-degree-rotatable rollable portable lockable collapsible expandable attic,
6) 360-degree-rotatable rollable portable lockable collapsible expandable awning,
7) 360-degree-rotatable rollable portable lockable collapsible expandable tent (for Camping/Exhibition),
8) 360-degree-rotatable rollable portable lockable collapsible expandable workshop with built-in tables (for functioning as car-and-boat body shop and car-and-boat-repairing shop),
9) 360-degree-rotatable rollable portable lockable collapsible expandable outdoor party and work tables,
10) 360-degree-rotatable rollable portable lockable collapsible expandable booth with built-in boot-sign frames, and
11) 360-degree-rotatable rollable portable lockable collapsible expandable RV port.

Referring to FIGS. 1A, 1B, 1C, 2A, 2B, 2C, 3, 4A, 4B, and 5, the unique 11-device-in-one system (of 360-degree-rotatable rollable portable lockable collapsible expandable carport, green house, gazebo, storage, attic, awnings, tent, workshop, outdoor tables, booth, and RV port) comprises:

1) Extendable collapsible frame system 101, comprising:
2) Round bars 102,
3) Square bars 103,
4) Bases 104,
5) 360-degree rotatable lockable wheels 105, and
6) Wheel connectors 106;
7) Connector system 107, comprising:
8) X-shaped round-bar connectors 108,
9) T-shaped round-bar connector 109,
10) U-shaped square-bar connectors 110,
11) Bolts 111,
12) Nuts 112,
13) Locking pins 113, and
14) Locking rings 114;
15) Adjustable foldable arm system 115, comprising:
16) First telescopic arms 116*a*, Second telescopic arms 116*b*,
17) U-shaped telescopic-arm connectors 117*a*, U-shaped foot-toe connectors 117*b*,
18) L-shaped telescopic-arm joints 118,
19) Rivets 119,
20) Feet 120, and
21) Toes 121;
22) Panel system 122, comprising:
23) Roof panels 123,
24) Side panels 124,
25) End panels 125,
26) Transparent inserts 126,
27) Panel-lifting VELCRO (hook and loop fasteners) 127,
28) Panel-sealing zippers 128,
29) Gap-covering panels 129,
30) Panel-sealing VELCRO (hook and loop fasteners) 130,
31) Panel-sealing grommets 131, and
32) Arm-securing ties 132; and
33) Bungee cord system 133, comprising:
34) Panel-attaching bungee cords 134, and
35) Bungee-cord-locking balls 135.

Material

Referring to FIGS. 1A, 1B, 1C, 2A, 2B, 2C, 3, 4A, 4B, and 5:

1) Extendable collapsible frame system 101 is made of the combined materials of its components.
2) Round bars 102 each are made of metal.
3) Square bars 103 each are made of metal.
4) Bases 104 each are made of metal.
5) 360-degree rotatable lockable wheels 105 each are made of rubber.
6) Wheel connectors 106 each are made of metal.
7) Connector system 107 is made of the combined materials of its components.
8) X-shaped round-bar connectors 108 each are made of metal.
9) T-shaped round-bar connector 109 each are made of metal.
10) U-shaped square-bar connectors 110 each are made of metal.
11) Bolts 111 each are made of metal.
12) Nuts 112 each are made of metal.
13) Locking pins 113 each are made of metal.
14) Locking rings 114 each are made of metal.
15) Adjustable foldable arm system 115 is made of the combined materials of its components.
16) First telescopic arms 116*a* each are made of metal and second telescopic arms 116*b* each are made of metal.
17) U-shaped telescopic-arm connectors 117*a* each are made of metal and U-shaped foot-toe connectors 117*b* each are made of metal.
18) L-shaped telescopic-arm joints 118 each are made of metal.
19) Rivets 119 each are made of metal.
20) Feet 120 each are made of metal.
21) Toes 121 each are made of metal.
22) Panel system 122 is made of the combined materials of its components.
23) Roof panels 123 each are made of fabric.
24) Side panels 124 each are made of fabric.
25) End panels 125 each are made of fabric.
26) Transparent inserts 126 each are made of clear plastic.
27) Panel-lifting VELCRO (hook and loop fasteners) 127 each are made of hook-and-loop material.
28) Panel-sealing zippers 128 each are made of metal.
29) Gap-covering panels 129 each are made of fabric.
30) Panel-sealing VELCRO (hook and loop fasteners) 130 each are made of hook-and-loop material.
31) Panel-sealing grommets 131 each are made of metal.
32) Arm-securing ties 132 each are made of fabric.
33) Bungee cord system 133 is made of the combined materials of its components.
34) Panel-attaching bungee cords 134 each are made of rubberized cords.
35) Bungee-cord-locking balls 135 each are made of rubber.

Shape

Referring to FIGS. 1A, 1B, 1C, 2A, 2B, 2C, 3, 4A, 4B, and 5:

1) Extendable collapsible frame system 101 has the combined shapes of its components.
2) Round bars 102 each have a cylindrical shape.
3) Square bars 103 each have an elongated cubical shape.
4) Bases 104 each have a square shape.
5) 360-degree rotatable lockable wheels 105 each have a round shape.
6) Wheel connectors 106 each have a cylindrical shape.
7) Connector system 107 has the combined shapes of its components.
8) X-shaped round-bar connectors 108 each have a X-shape.
9) T-shaped round-bar connector 109 each have a T-shape.
10) U-shaped square-bar connectors 110 each have a U-shape.
11) Bolts 111 each have a octagonal shape with an empty space.
12) Nuts 112 each have a round shape.
13) Locking pins 113 each have a elongated shape.
14) Locking rings 114 each have a round shape.
15) Adjustable foldable arm system 115 has the combined shapes of its components.
16) First telescopic arms 116*a* each have a cylindrical shape.
Second telescopic arms 116*b* each have a cylindrical shape.
17) U-shaped telescopic-arm connectors 117*a* each have a U-shape.
U-shaped foot-toe connectors 117*b* each have a U-shape.
18) L-shaped telescopic-arm joints 118 each have a L-shape.
19) Rivets 119 each have a round shape.
20) Feet 120 each have a round shape.
21) Toes 121 each have a elongated shape.
22) Panel system 122 has the combined shapes of its components.
23) Roof panels 123 each have a rectangular shape.
24) Side panels 124 each have a rectangular shape.
25) End panels 125 each have a rectangular shape.
26) Transparent inserts 126 each have a rectangular shape.
27) Panel-lifting VELCRO (hook and loop fasteners) 127 each have a elongated shape.
28) Panel-sealing zippers 128 each have a elongated shape.
29) Gap-covering panels 129 each have a rectangular shape.
30) Panel-sealing VELCRO (hook and loop fasteners) 130 each have a elongated shape.
31) Panel-sealing grommets 131 each have a round shape.
32) Arm-securing ties 132 each have a elongated shape.
33) Bungee cord system 133 has the combined shapes of its components.
34) Panel-attaching bungee cords 134 each have a elongated shape.
35) Bungee-cord-locking balls 135 each have a round shape.

Connection

Referring to FIGS. 1A, 1B, 1C, 2A, 2B, 2C, 3, 4A, 4B, and 5:

1) Extendable collapsible frame system 101 has the combined connections of its components.
2) Round bars 102 respectively are attached to square bars 103 and bases 104.
3) Square bars 103 respectively are attached to round bars 102 and bases 104.
4) Bases 104 respectively are attached to round bars 102 and square bars 103.
5) 360-degree rotatable lockable wheels 105 respectively are inserted into wheel connectors 106.
6) Wheel connectors 106 respectively connect 360-degree rotatable lockable wheels 105 to bases 104.
7) Connector system 107 has the combined connections of its components.
8) X-shaped round-bar connectors 108 respectively connect round bars 102 together.
9) T-shaped round-bar connectors 109 respectively connect round bars 102 together.
10) U-shaped square-bar connectors 110 respectively connect round bars 102 and square bars 103 together.
11) Bolts 111 respectively hold nuts 112 to x-shaped round-bar connectors 108, t-shaped round-bar connectors 109, and u-shaped square bar connectors 110.
12) Nuts 112 respectively are screwed on bolts 111.
13) Locking pins 113 respectively are inserted through U-shaped square-bar connectors 110.
14) Locking rings 114 respectively are snap-locked on locking pins 113.
15) Adjustable foldable arm system 115 has the combined connections of its components.
16) First telescopic arms 116*a* respectively are connected to U-shaped telescopic-arm connectors 117*a* and L-shaped telescopic-arm joints 118.
Second telescopic arms 116*b* respectively are connected to L-shaped telescopic-arm joints 118.
17) U-shaped telescopic-arm connectors 117*a* respectively are connected to first telescopic arms 116*a*.
U-shaped foot-toe connectors 117*b* respectively are welded to first telescopic arms 116*a*.
18) L-shaped telescopic-arm joints 118 respectively are connected to first telescopic arms 116*a* and second telescopic arms 116*b*.
19) Rivets 119 respectively are attached to L-shaped telescopic-arm joints 118, first telescopic arms 116*a*, and second telescopic arms 116*b*.
20) Feet 120 respectively are welded to second telescopic arms 116*b*.
21) Toes 121 respectively are welded to feet 120.
22) Panel system 122 has the combined connections of its components.
23) Roof panels 123 respectively are attached to round bars 102.
24) Side panels 124 respectively are attached to round bars 102.
25) End panels 125 respectively are attached to round bars 102.
26) Transparent inserts 126 respectively are attached to side panels 124.
27) Panel-lifting VELCRO (hook and loop fasteners) 127 respectively are attached to end panels 125.
28) Panel-sealing zippers 128 respectively are attached to end panels 124.
29) Gap-covering panels 129 respectively are attached to side panels 124 and end panels 125.
30) Panel-sealing VELCRO (hook and loop fasteners) 130 respectively are attached to roof panels 123, side panels 124, and end panels 125.
31) Panel-sealing grommets 131 respectively are attached to roof panels 123, side panels 124, and end panels 126.
32) Arm-securing ties 132 respectively are sewn on side panels 124 and end panels 125.
33) Bungee cord system 133 has the combined connections of its components.
34) Panel-attaching bungee cords 134 respectively are tied to bungee-cord-locking balls 135.
35) Bungee-cord-locking balls 135 respectively are tied to panel-attaching bungee cords 134.

Function

Referring to FIGS. 1A, 1B, 1C, 2A, 2B, 2C, 3, 4A, 4B, and 5:

1) Extendable collapsible frame system 101 is for performing the combined functions of its components.
2) Round bars 102 respectively are for:
Connecting X-shaped round-bar connectors 108 and T-shaped round-bar connector 109 together.
3) Square bars 103 respectively are for:
Connecting U-shaped square-bar connectors 110 together.
4) Bases 104 respectively are for:
Stabilizing round bars 102.
5) 360-degree rotatable lockable wheels 105 respectively are for:
Making it easy to move around the unique 10-device-in-one system.
6) Wheel connectors 106 respectively are for:
Connecting 360-degree rotatable lockable wheels 105 to bases 104.
7) Connector system 107 is for performing the combined functions of its components.
8) X-shaped round-bar connectors 108 respectively are for:
Connecting round bars 102 together.
9) T-shaped round-bar connector 109 respectively are for:
Connecting round bars 102 together.
10) U-shaped square-bar connectors 110 respectively are for:
Connecting square bars 103 together.
11) Bolts 111 respectively are for:
Connecting X-shaped round-bar connectors 108, T-shaped round-bar connector 109, U-shaped square-bar connectors 110, round bars 102, square bars 103, and bases 104 together.
12) Nuts 112 respectively are for:
Securing bolts 111.
13) Locking pins 113 respectively are for:
Locking square bars 103 to U-shaped square-bar connectors 110.
14) Locking rings 114 respectively are for:
Locking locking pins 113 to U-shaped square-bar connectors 110.
15) Adjustable foldable arm system 115 is for performing the combined functions of its components.
16) First telescopic bars 116*a* respectively are for:
Supporting side panels 124.
Second telescopic bars 116*b* respectively are for:
Supporting first telescopic bars 116*a* and side panels 124.
17) U-shaped telescopic-bar connectors 117*a* respectively are for:
Connecting square bars 103 to first telescopic bars 116*a* and second telescopic bars 116*b*.
U-shaped foot-toe connectors 117*b* respectively are for:
Connecting feet 120 and toes 121 to X-shaped round-bar connectors 108 and T-shaped round-bar connector 109.
18) L-shaped telescopic-bar joints 118 respectively are for:
Connecting first telescopic bars 116*a* and second telescopic bars 116*b* together.
19) Rivets 119 respectively are for:
Pivotably connecting first telescopic bars 116*a* and second telescopic bars 116*b* to L-shaped telescopic-bar joints 118.
20) Feet 120 respectively are for:
Stabilizing the unique 10-device-in-one system.
21) Toes 121 respectively are for:
Securing feet 120 to U-shaped foot-toe connectors 117*b*.
22) Panel system 122 is for performing the combined functions of its components.
23) Roof panels 123 respectively are for:
Covering the top of the unique 11-device-in-one system.
24) Side panels 124 respectively are for:
Covering the sides of the unique 11-device-in-one system.
25) End panels 125 respectively are for:
Covering the ends of the unique 11-device-in-one system.
26) Transparent inserts 126 respectively are for:
Covering the mid sections of side panels 124 and end panels 125.
27) Panel-lifting VELCRO (hook and loop fasteners) 127 respectively are for:
Securing end panels 125 after end panels 125 are rolled up.
28) Panel-sealing zippers 128 respectively are for:
Securing end panels 125 after end panels 125 are dropped down.
29) Gap-covering panels 129 respectively are for:
Covering gaps between roof panels 123, side panels 124, and end panels 125.
30) Panel-sealing VELCRO (hook and loop fasteners) 130 respectively are for:
Securing gap-covering panels 129 to roof panels 123, side panels 124, and end panels 125.
31) Panel-sealing grommets 131 respectively are for:
Threading panel-attaching bungee cords 134 therethrough.
32) Arm-securing ties 132 respectively are for:
Tying adjustable foldable arm system 115 to extendable collapsible frame system 101.
33) Bungee cord system 133 is for performing the combined functions of its components.
34) Panel-attaching bungee cords 134 respectively are for:
Connecting roof panels 123, side panels 124, end panels 125 together.
35) Bungee-cord-locking balls 135 respectively are for:
Securing panel-attaching bungee cords 134 to panel-sealing grommets 131.

Operation

How to Operate First Telescopic Arms 116*a* and Second Telescopic Arms 116*b*

Figure 1B:
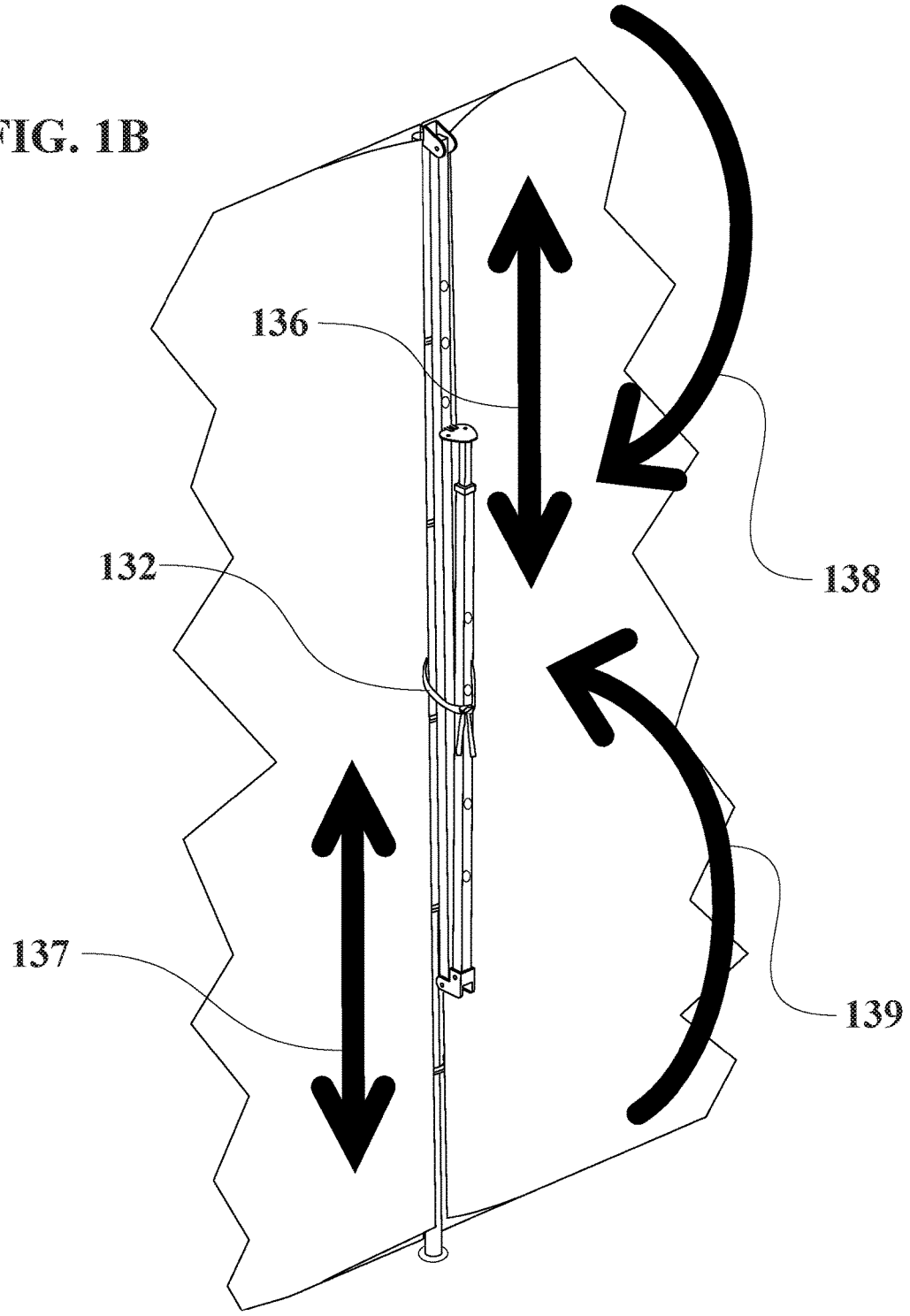
FIG. 1B illustrates a perspective view of a telescopic arm in a collapsed retracted position.

Referring to FIGS. 1A and 1B:

First telescopic arms 116*a* can be retracted and extended, in the directions of double-headed arrow 136.

Second telescopic arms 116*b* can be retracted and extended, in the directions of double-headed arrow 137.

First telescopic arms 116*a* can be folded, in the direction of arrow 138.

Second telescopic arms 116*b* can be folded, in the direction of arrow 139.

Figure 1C:
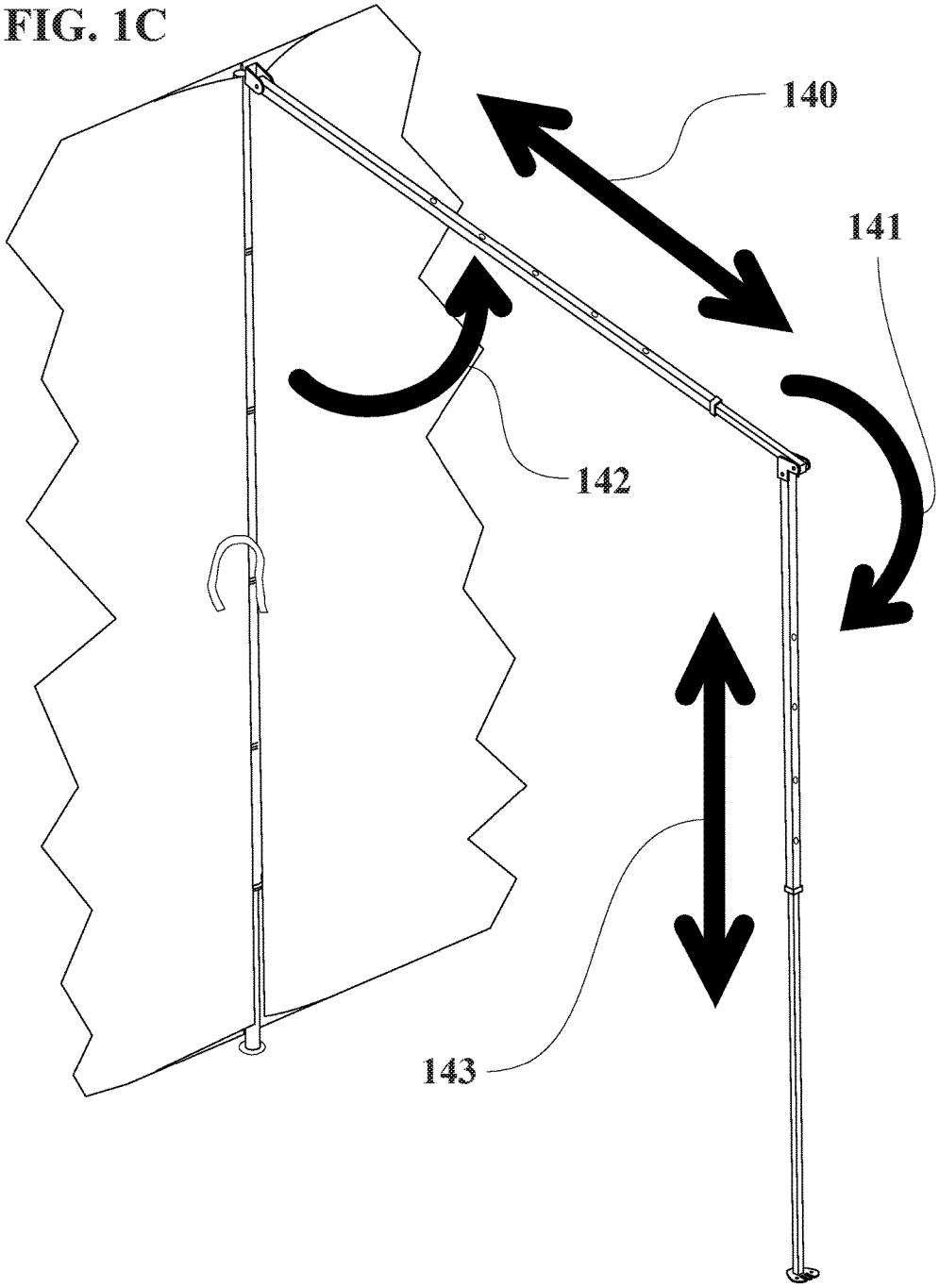
FIG. 1C illustrates a perspective view of a telescopic arm in a unfolded extended position.
Figure 2A:
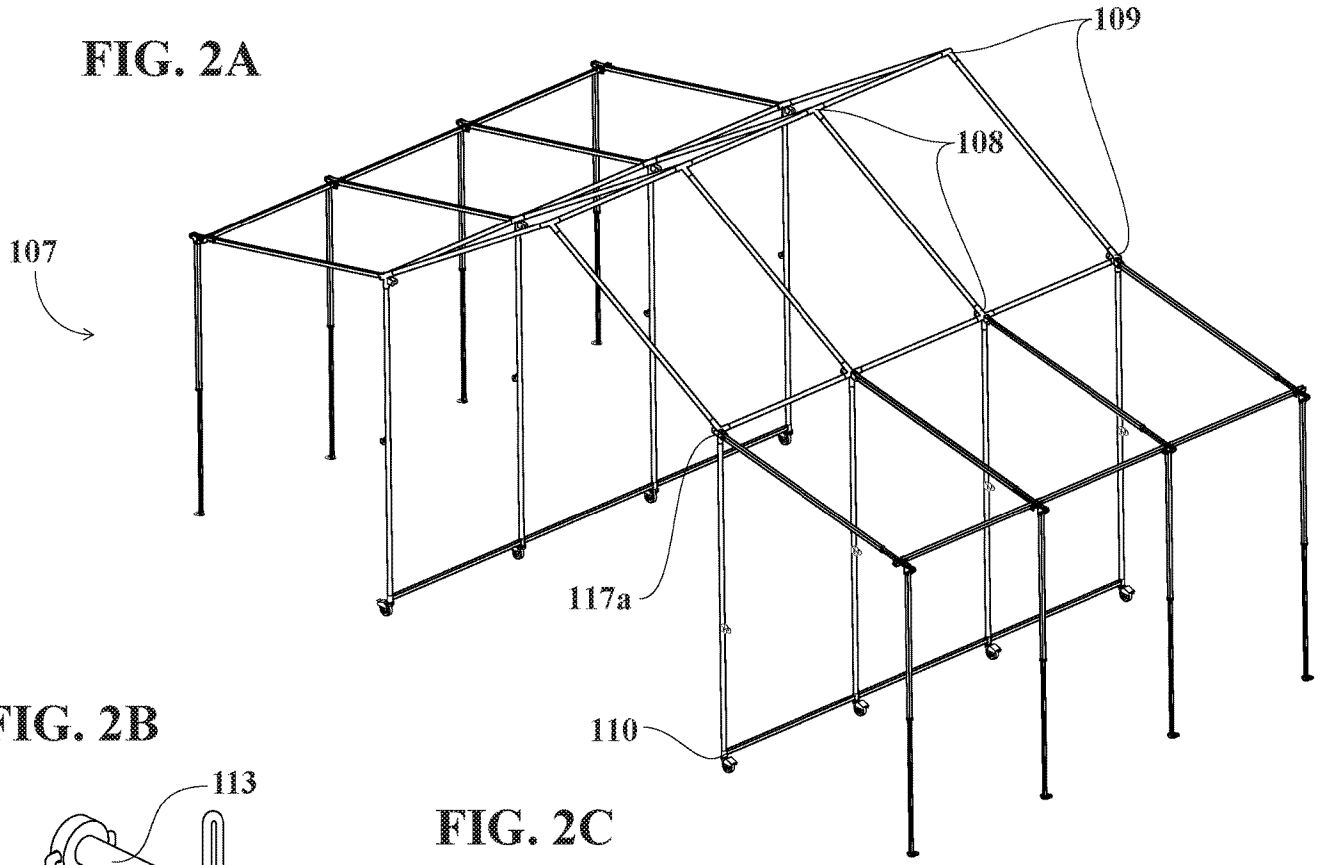
FIG. 2A illustrates a perspective view of an expanded frame system of the 360-degree rotatable rollable portable lockable collapsible expandable carport, green house, gazebo, storage, attic, awning, tent, workshop, outdoor table, booth, and RV port.
Figure 2C:
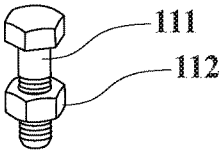
FIG. 2C illustrates a perspective view of a nut and bolt of the connector system.
Figure 2B:
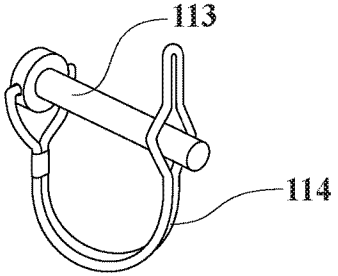
FIG. 2B illustrates a perspective view of a locking pin and locking ring
Figure 3:
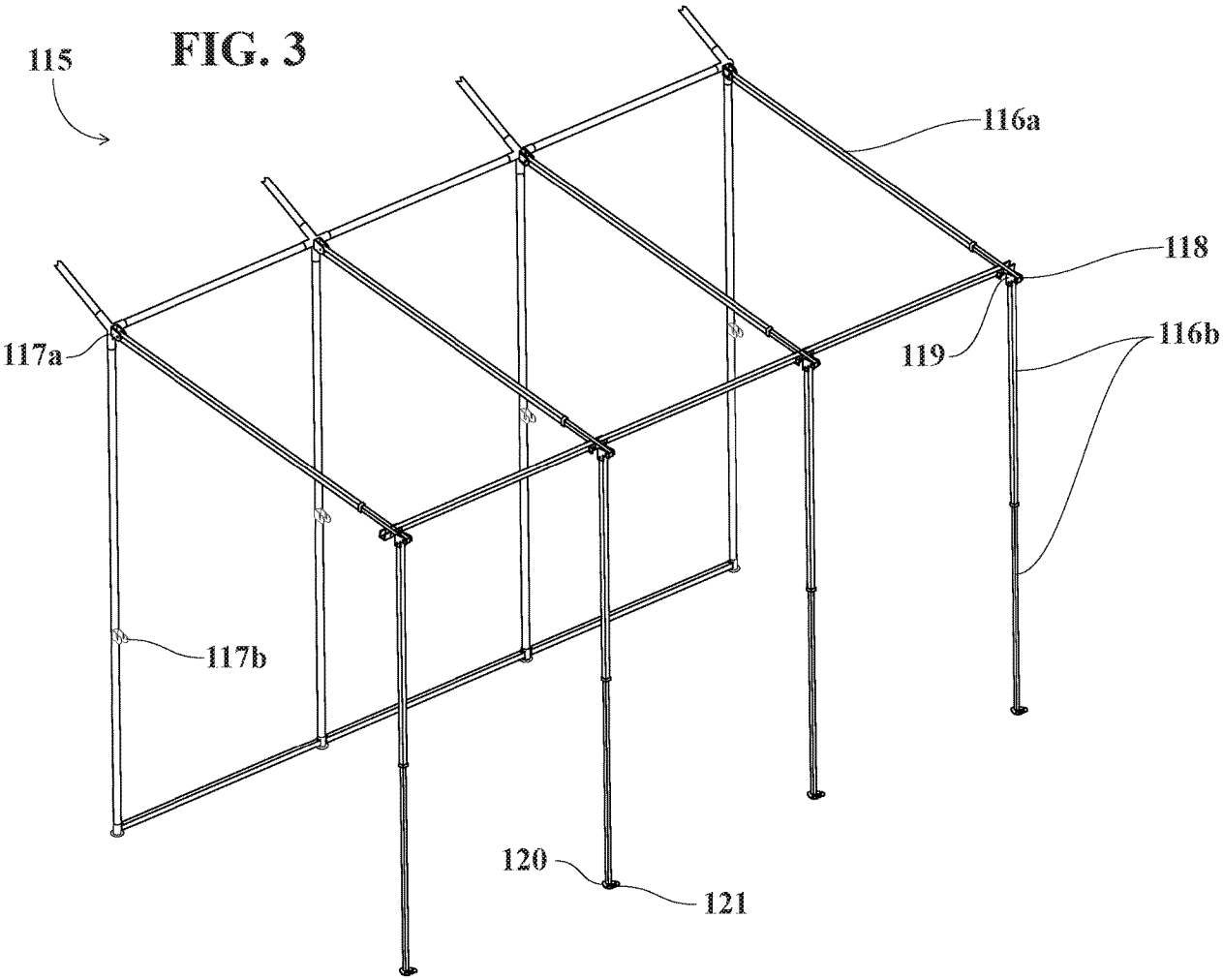
FIG. 3 illustrates a perspective view of an adjustable foldable arm system.
Figure 4A:
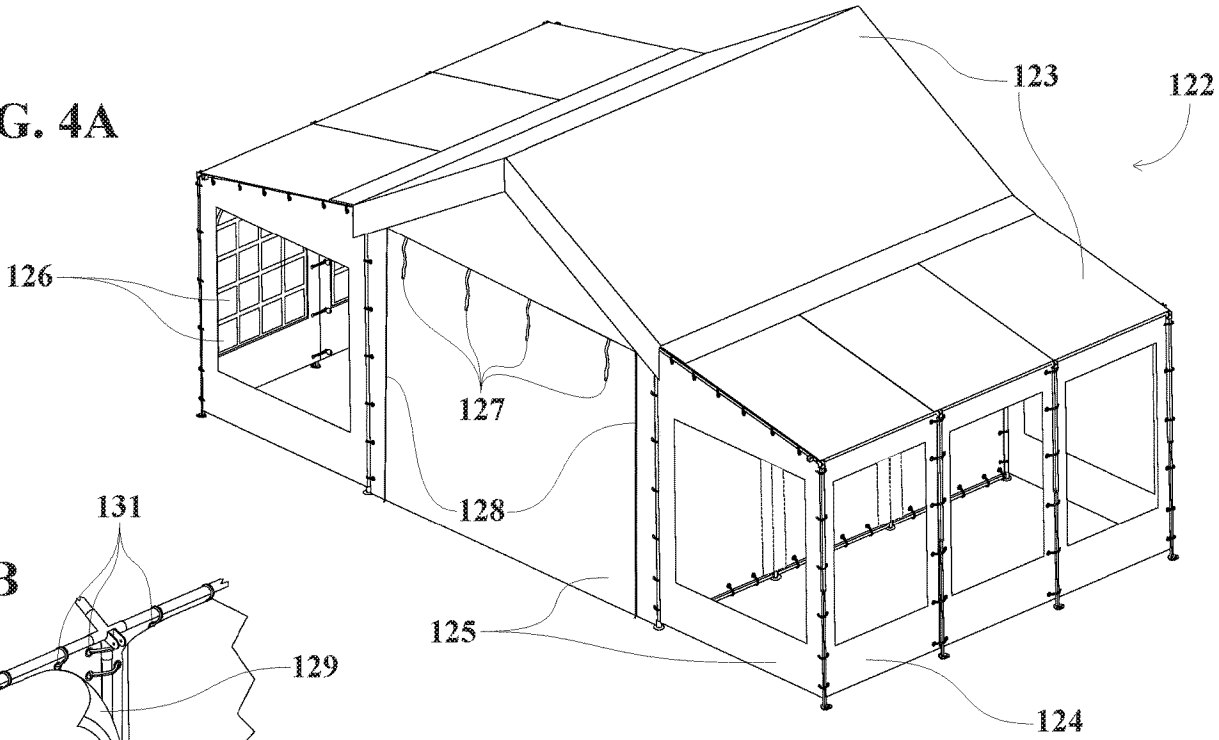
FIGS. 4A and 4B illustrate perspective views of how a panel system is attached to a frame system.
Figure 4B:
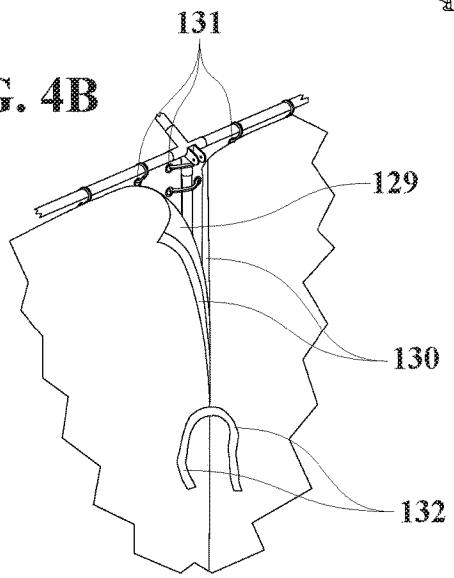
Figure 5:
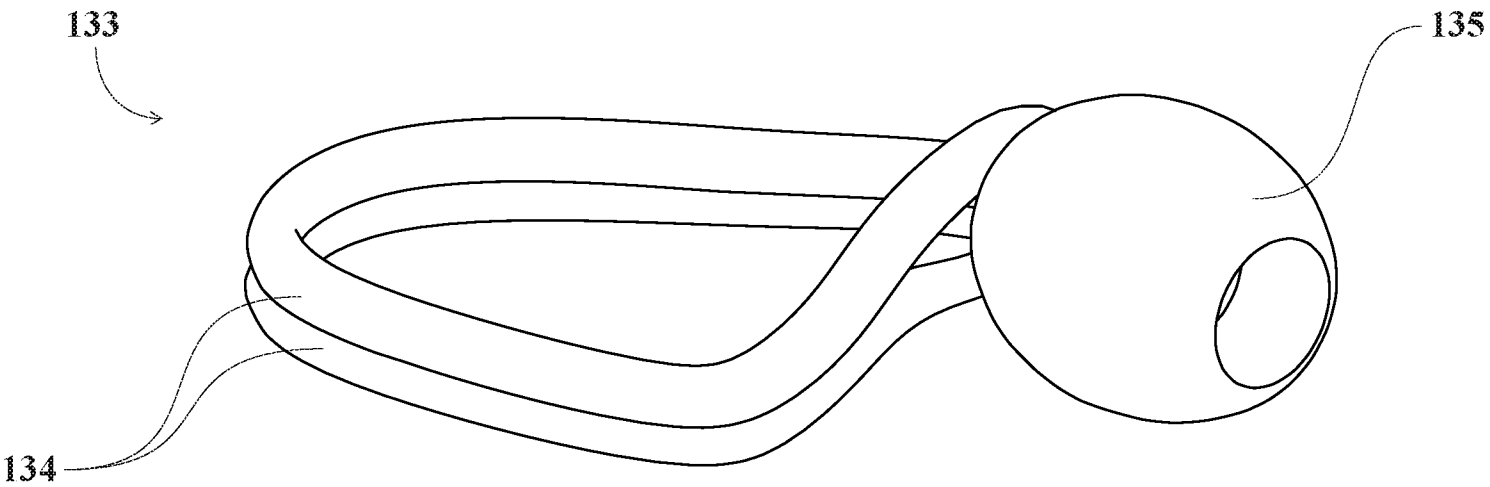
FIG. 5 illustrates a perspective view of a bungee cord system.

Referring to FIG. 1C:

First telescopic arms 116*a* can be retracted and extended, in the directions of double-headed arrow 140.

Second telescopic arms 116*b* can be unfolded, in the direction of arrow 141.

First telescopic arms 116*a* can be unfolded, in the direction of arrow 142.

Second telescopic arms 116*b* can be retracted and extended, in the directions of double-headed arrow 143.

How to Assemble a Carport

Figure 6:
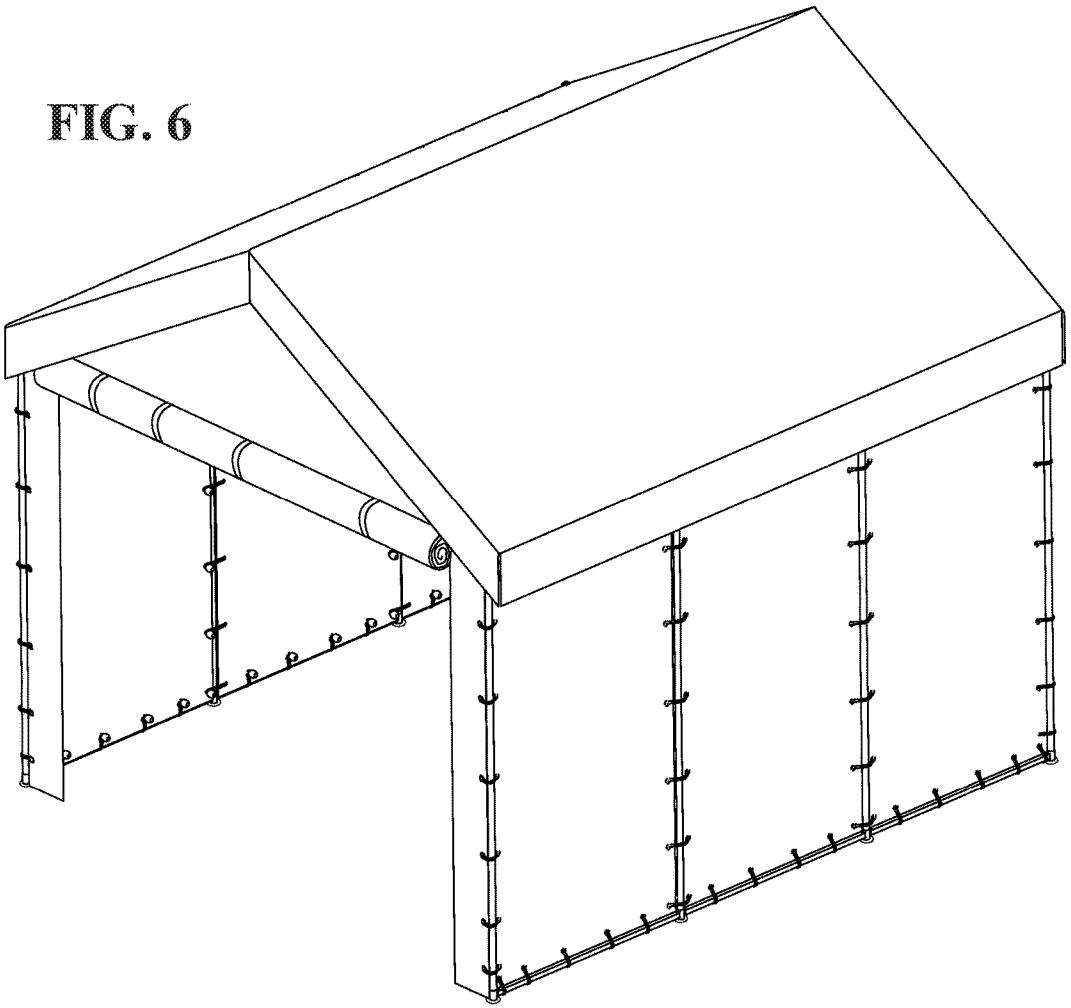
FIG. 6 illustrates a perspective view of the unique 11-device-in-one system used as a carport.

FIG. 6 illustrates a perspective view of the unique 11-device-in-one system used as a carport.

How to Assemble a Tent (for Camping/Exhibition)

Figure 7:
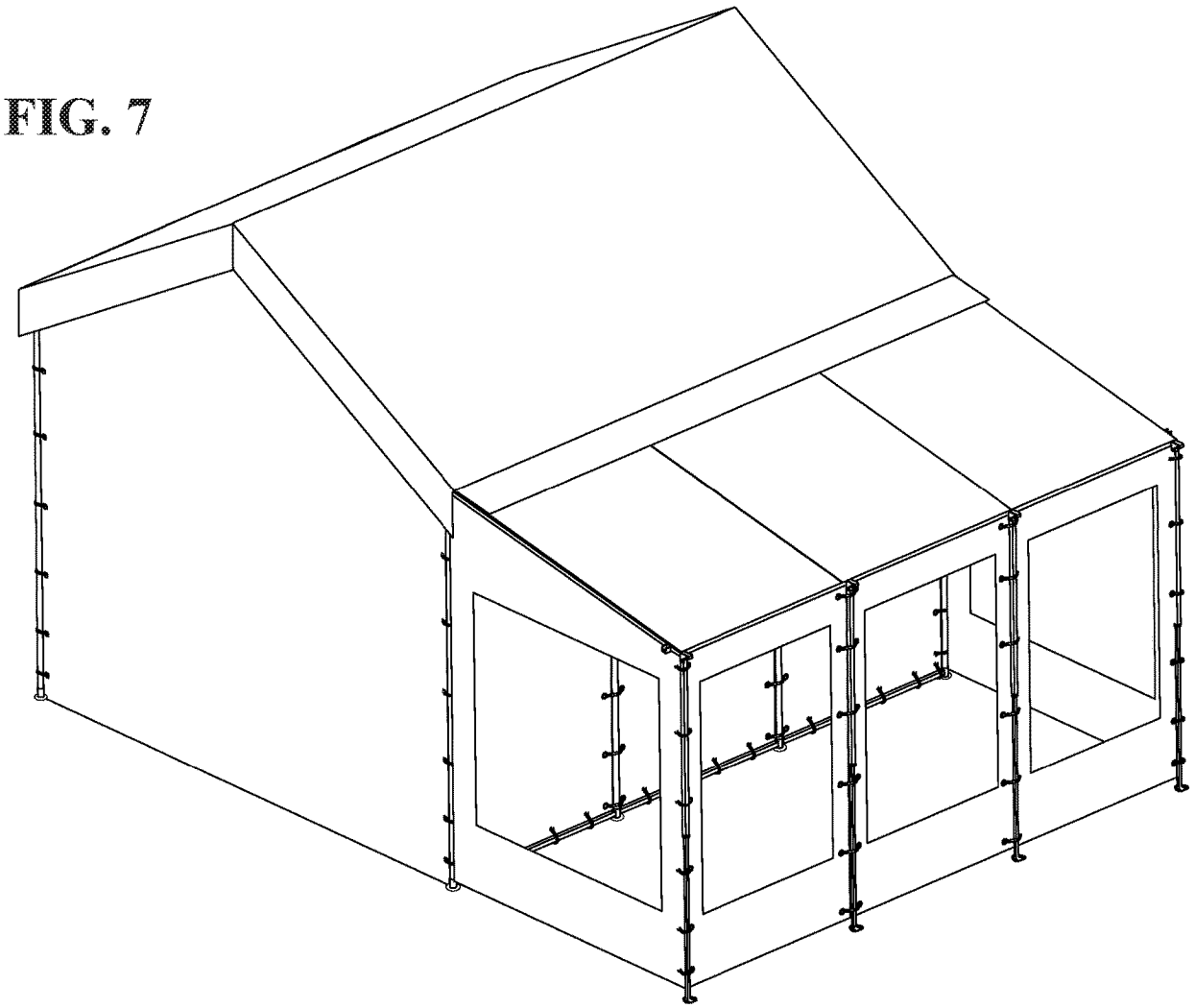
FIG. 7 illustrates a perspective view of the unique 11-device-in-one system used as a tent (for camping/exhibition), or a gazebo.

FIG. 7 illustrates a perspective view of the unique 11-device-in-one system used as a tent (for camping/exhibition).

How to Assemble a Gazebo

FIG. 7 illustrates a perspective view of the unique 11-device-in-one system used as a gazebo.

How to Assemble a Storage

Figure 8A:
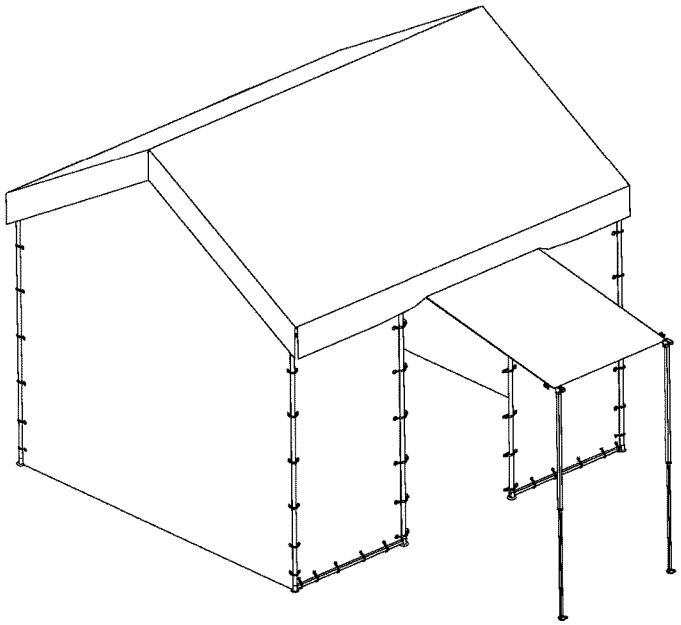
FIGS. 8A and 8B illustrate perspective views of the unique 11-device-in-one system used as a storage.
Figure 8B:
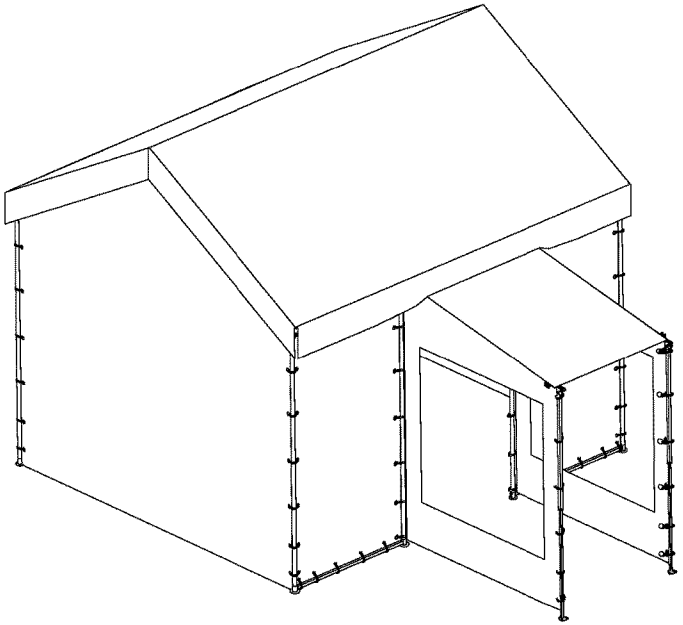

FIGS. 8A and 8B illustrate perspective views of the unique 11-device-in-one system used as a storage.

How to Assemble a Green House

Figure 9:
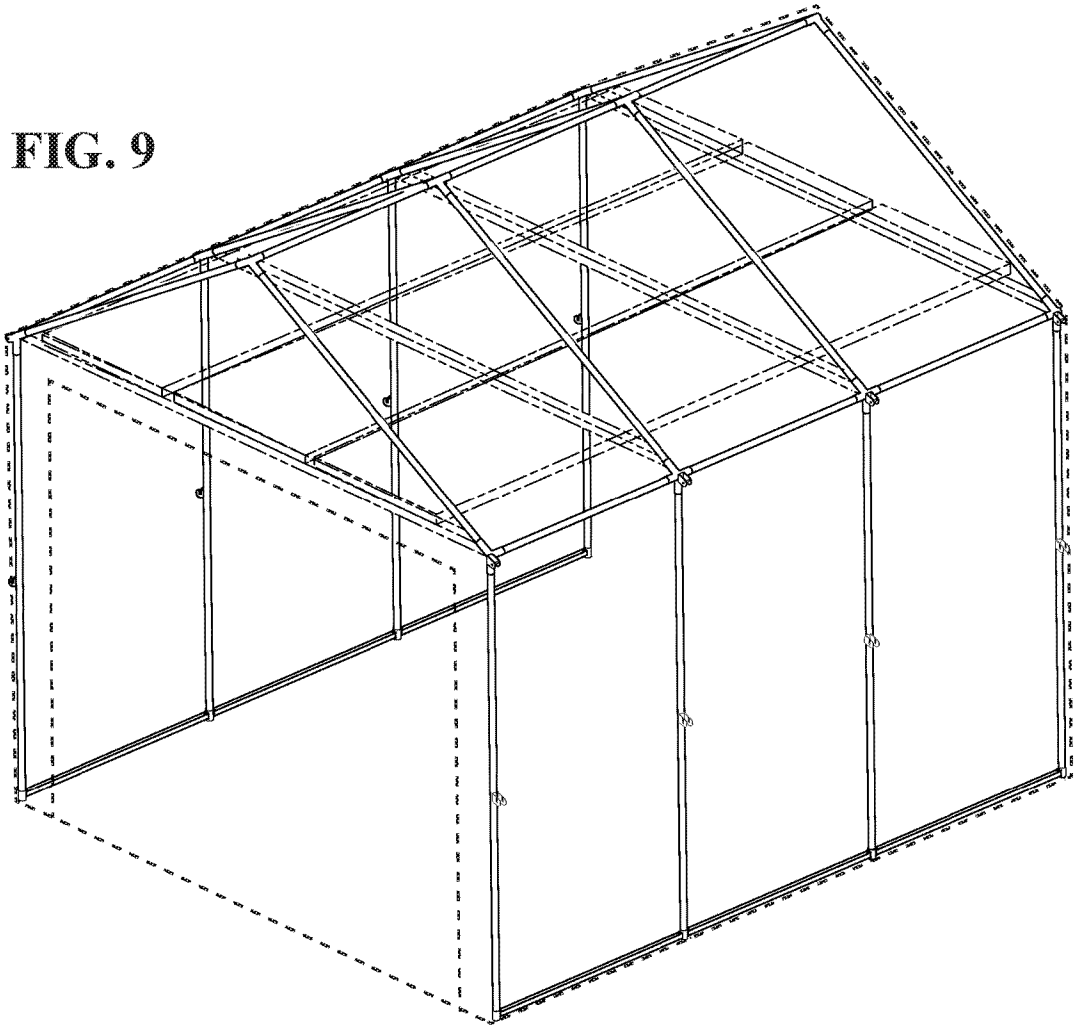
FIG. 9 illustrates a perspective view of the unique 11-device-in-one system used as a green house and a storage attic.

FIG. 9 illustrates a perspective view of the unique 11-device-in-one system used as a green house.

How to Assemble a Storage Attic

FIG. 9 illustrates a perspective view of the unique 11-device-in-one system used as a storage attic.

How to Assemble an Awning System

Figure 10:
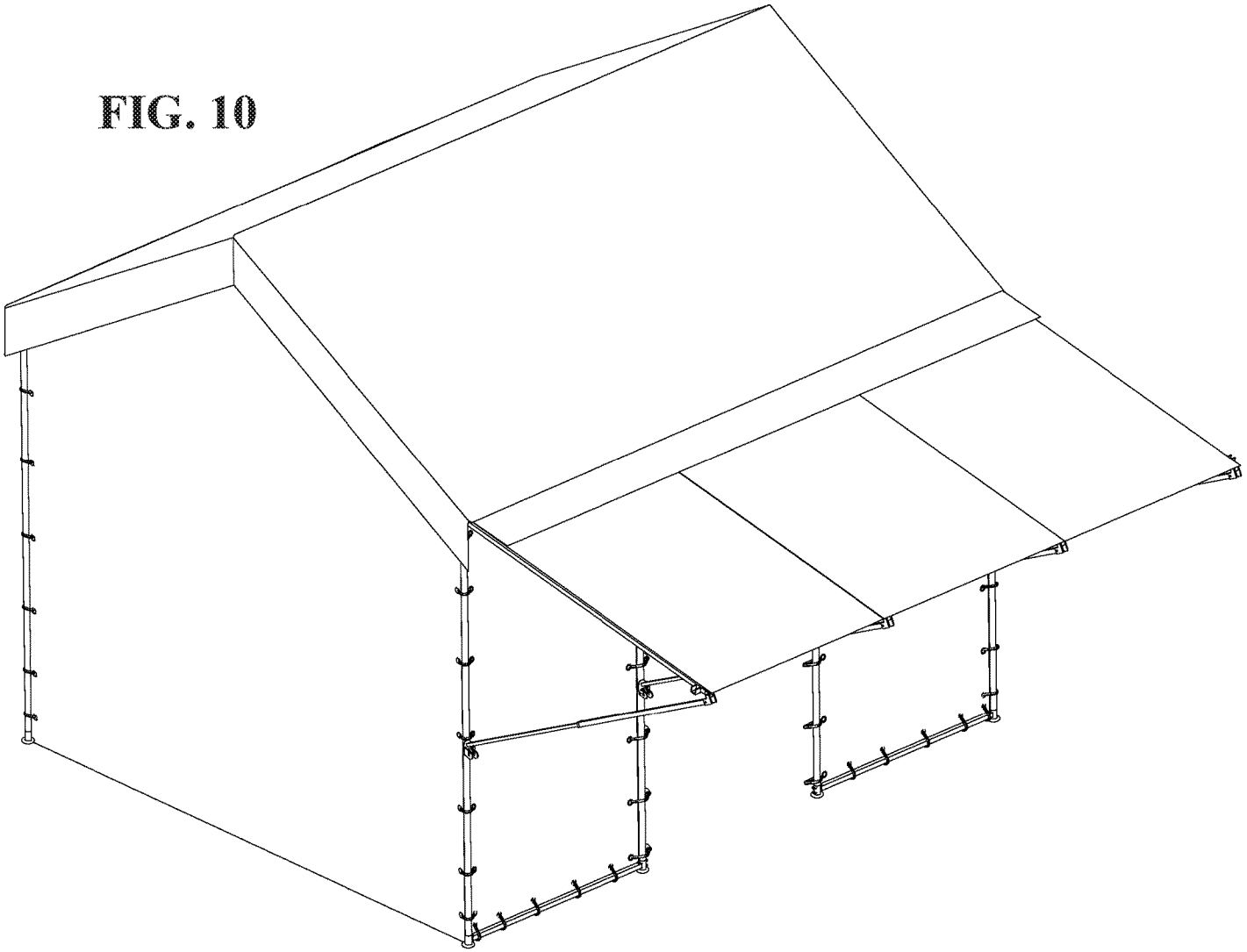
FIG. 10 illustrates a perspective view of the unique 11-device-in-one system used as an awning system.

FIG. 10 illustrates a perspective view of the unique 11-device-in-one system used as an awning system.

How to Assemble a Workshop with Built-In Tables

Figure 11:
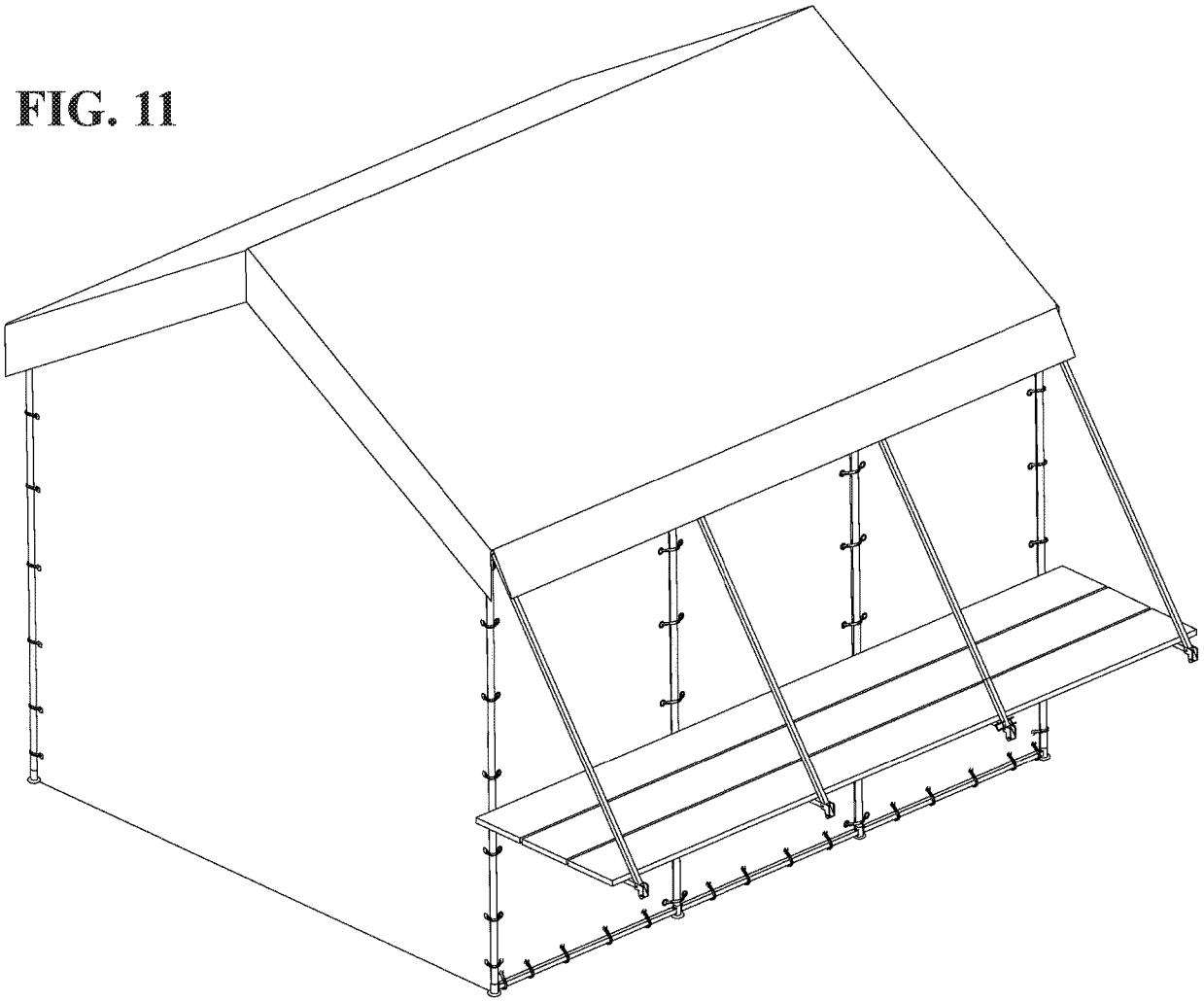
FIG. 11 illustrates a perspective view of the unique 11-device-in-one system used as a workshop with table or an outdoor party table.

FIG. 11 illustrates a perspective view of the unique 11-device-in-one system used as a workshop with built-in tables.

How to Assemble Outdoor Party Tables

FIG. 11 illustrates a perspective view of the unique 11-device-in-one system used as outdoor party tables.

How to Adjust and Secure Feet 120 and Toes 121

Figure 12:
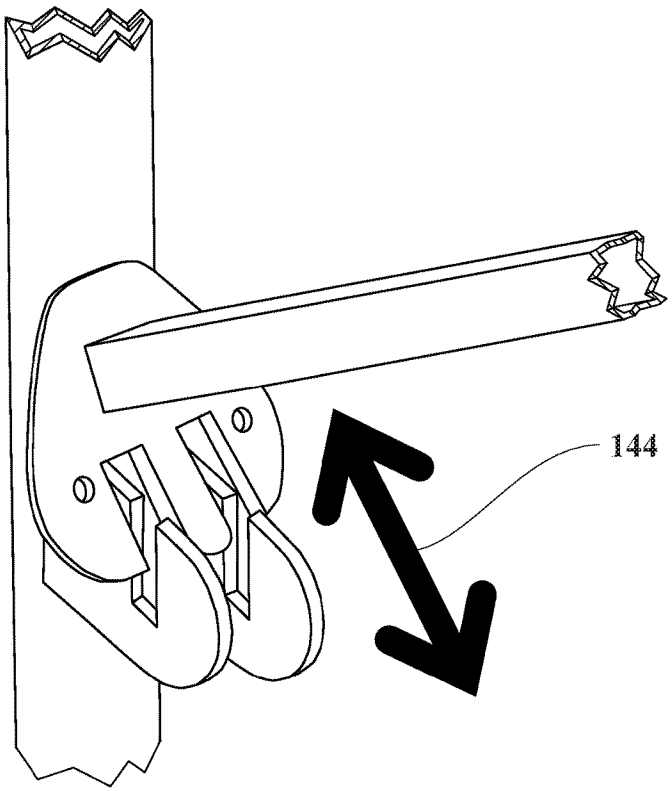
FIG. 12 illustrates a perspective view of how the feet and toes of the adjustable foldable arm system hook on a U-shaped connector.

FIG. 12 illustrates a perspective view of how to adjust, lock, and unlock feet 120 and toes 121 of adjustable foldable arm system 115 on U-shaped foot-toe connectors 117*b*, in the directions of double-headed arrow 144.

How to Assemble and Secure

Figure 13:
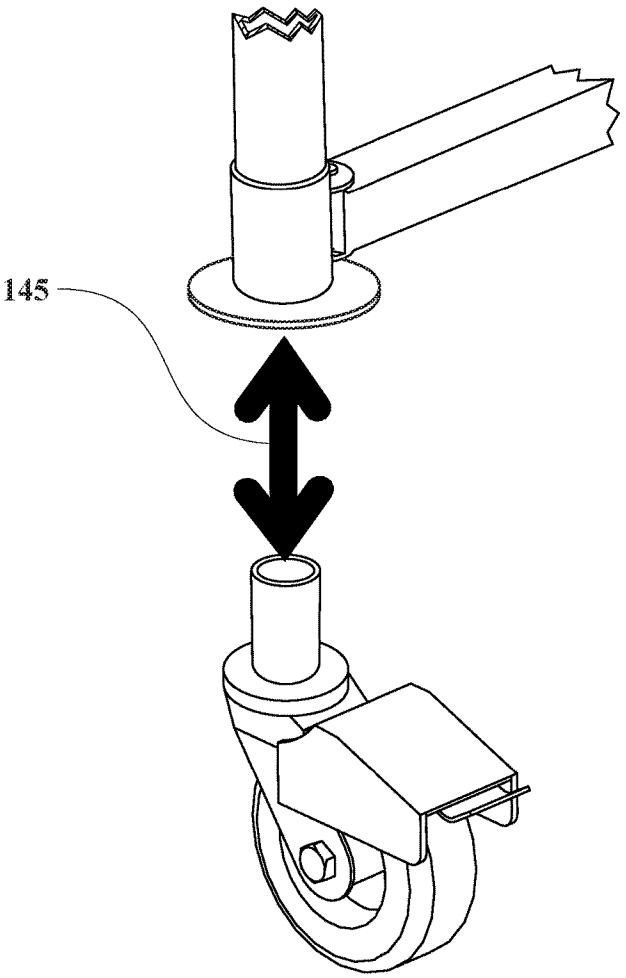
FIG. 13 illustrates a perspective view of how a 360-degree rotatable lockable wheel and wheel connectors attach to the frame system of the unique 11-device-in-one system.

FIG. 13 illustrates a perspective view of how to assemble and disassemble 360-degree rotatable lockable wheels 105 and wheel connectors 106 to and from bases 104 respectively, in the directions of double-headed arrow 145.

How to Assemble a Booth with Built-in Booth-Sign Frame

Figure 14:
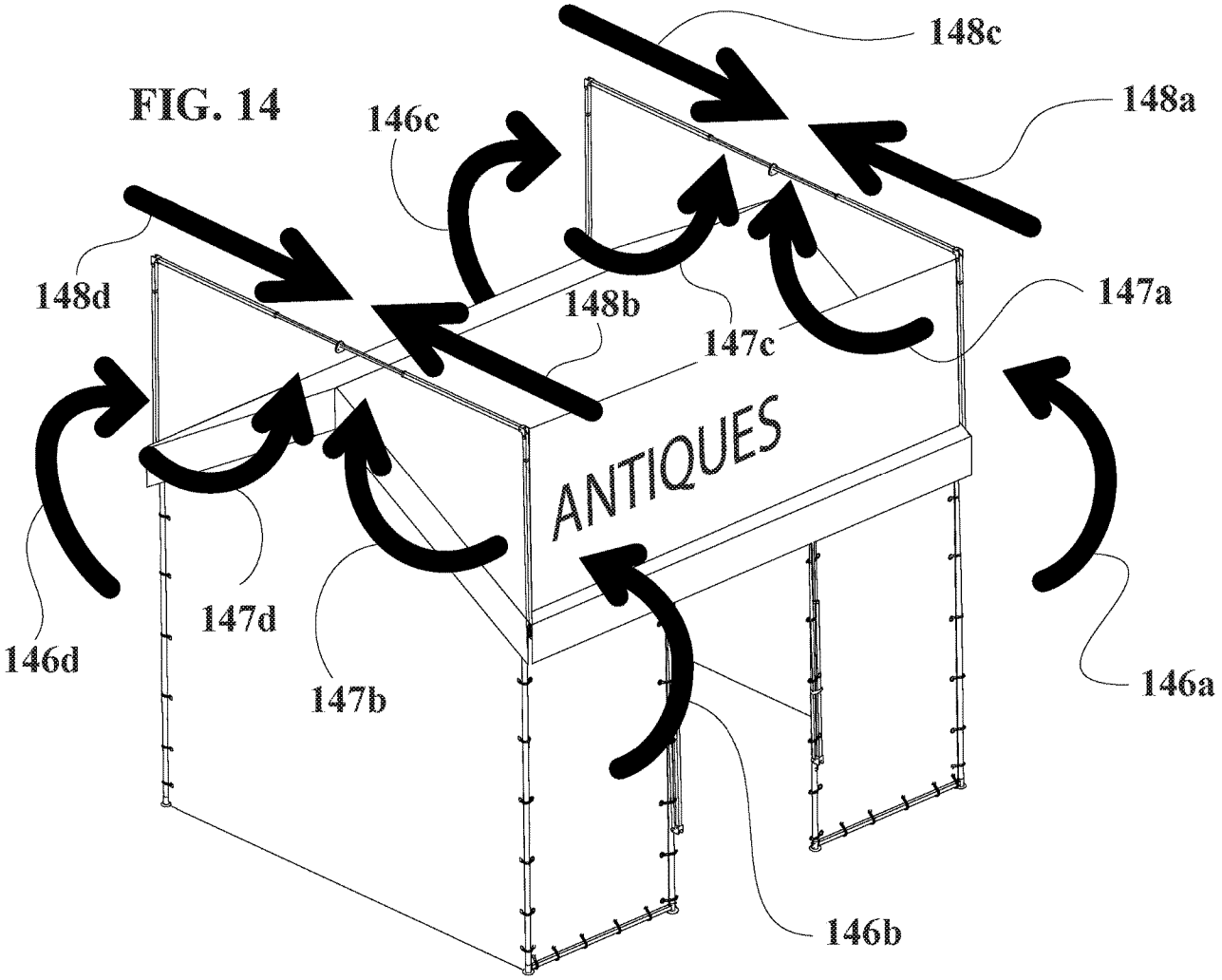
FIG. 14 illustrates a perspective view of the unique 11-device-in-one system used as a booth with a business sign.

FIG. 14 illustrates a perspective view of the unique 11-device-in-one system used as a booth with built-in booth-sign frames.

First telescopic arms 116*a* can be unfolded upward, in the directions of arrows 146*a*, 146*b*, 146*c*, and 146*d*.

Next, second telescopic arms 116*b* can be unfolded outward, in the directions of arrows 147*a*, 147*b*, 147*c*, and 147*d*.

Then, second telescopic arms 116*b* can be extended, in the directions of arrows 148*a*, 148*b*, 148*c*, and 148*d*.

How to Assemble an RV Port

Figure 15A:
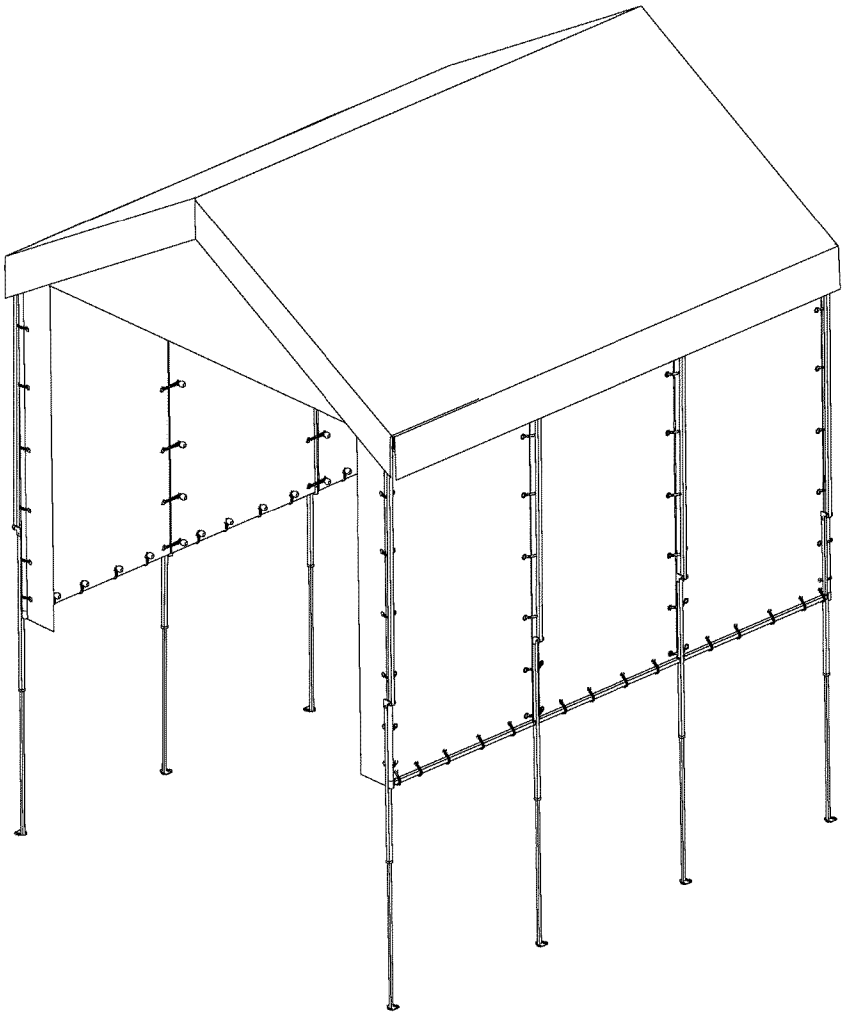
FIGS. 15A and 15B illustrate a perspective view and a front view of the unique 11-device-in-one system used as an RV port.
Figure 15B:
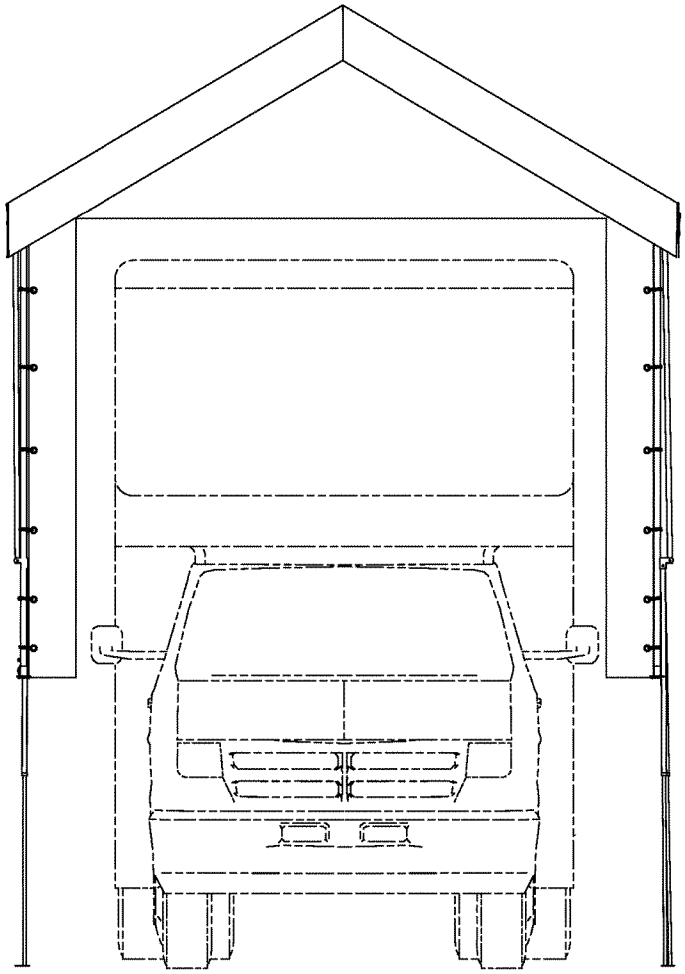

FIGS. 15A and 15B illustrate a perspective view and a front view of the unique 11-device-in-one system used as an RV port.

MAJOR ADVANTAGES OF THE INVENTION

The present invention substantially departs from the conventional concepts and designs of the prior art. In doing so, the present invention provides a unique 11-device-in-one system having many unique and significant features, functions, and advantages, which overcome all the disadvantages of the prior art, as follows:

1) It is an object of the new invention to provide a unique 11-device-in-one system,
   having 11-device-in-one system.
   Therefore, the unique 11-device-in-one system:
   a) Can foldably and unfoldably transform into,
      a rollable, portable, lockable, collapsible carport (FIG. 6),
      a rollable, portable, lockable, collapsible gazebo (FIG. 8A),
      a rollable, portable, lockable, collapsible storage space (FIG. 9),
      a rollable, portable, lockable, collapsible greenhouses (FIG. 4A),
      a rollable, portable, lockable, collapsible attic space (FIG. 9),
      a rollable, portable, lockable, collapsible RV port (FIGS. 15A and 15B),
      a rollable, portable, lockable, collapsible exhibition tent (FIG. 4A),
      a rollable, portable, lockable, collapsible camping tent (FIGS. 8A and 8B),
      a rollable, portable, lockable, collapsible automotive workshop (FIGS. 4A, 7, 10, and 11),
      a rollable, portable, lockable, collapsible marine workshop (FIGS. 4A, 7, 10, and 11),
      a rollable, portable, lockable, collapsible outdoor party space (FIGS. 4A, 7, 10, and 11), and
      a rollable, portable, lockable, collapsible fair and trade-show booth having an adjustable foldable arm system swinging over the booth and forming a booth-sign frame (FIG. 14);
   b) Can interchange from 11 devices,
      to be economically used and multi-purposeful; and
   c) Can interchange from 11 devices
      to save materials, labor, time, space, and money.
2) It is another object of the new invention to provide a unique 11-device-in-one system,
   having 11 shape-shifting capabilities.
   Therefore, the unique 11-device-in-one system:
   a) Can trap light and magnify properties,
      to convert the unique 11-device-in-one system into a greenhouse;
   b) Can optionally configure the panel system in conjunction with the adjustable foldable arm system,
      to form adjacent rooms on either side of the greenhouse;
   c) Can optionally configure the panel system in conjunction with the adjustable foldable arm system,
      to form adjacent rooms on either side of the camping tent; and
   d) Can combine with a vapor barrier in the attic
      to create a thermo insulating buffer, minimizing cold temperatures.
3) It is still another object of the new invention to provide a unique 11-device-in-one system,
   having an adjustable foldable arm system with unique feet and toes.
   Therefore, the unique 11-device-in-one system:
   a) Can expand and fold instantly
      to put away for self storage or when collapsing for transport;
   b) Can allow quick and easy conversion from use as an auxiliary room or storage space,
      to a storage shelf;
   c) Can allow quick and easy conversion from use as an auxiliary room or storage space,
      to an awning; and
   d) Can allow quick and easy conversion from use as an auxiliary room or storage space,
      to a table.
4) It is a further object of the new invention to provide a unique 11-device-in-one system,
   having an adjustable foldable arm system with unique feet and toes.

Therefore, the unique 11-device-in-one system:

a) Can allow quick and easy conversion from use as an auxiliary room or storage room to a food preparation and serving space;

b) Can allow quick and easy conversion from use as an auxiliary room or storage room, to a retail display shelving space;

c) Can allow quick and easy conversion from use as an auxiliary room or storage space, to a product display and sales space;

d) Can allow quick and easy conversion from use as an auxiliary room or storage space, to a beverage preparation, display, and sales area;

e) Can allow quick and easy conversion from use as an auxiliary room or storage space, to a workspace for group processing; and f) Can allow quick and easy conversion from use as an auxiliary room or storage space, to a table for food preparation, serving, and dining space.

5) It is an even further object of the new invention to provide a unique 11-device-in-one system, having unique feet, toes, and 360-degree rotatable lockable wheels.

Therefore, the unique 11-device-in-one system:

a) Can transfer the 11-device-in-one system, to be implanted on grass, asphalt parking lot and gravel outdoor areas;

b) Can transfer the 11-device-in-one system, to be implanted on tile, hardwood, carpet and linoleum indoor areas;

c) Can accommodate multiple positions to allow use in multiple locations; and d) Can lockingly be positioned in one place, to securely remain in a desired location.

6) It is still another object of the new invention to provide a unique 11-device-in-one system, having unique feet and toes.

Therefore, the unique 11-device-in-one system:

a) Can interlock with the u-shaped foot-toe connectors, to create a secure gravitational-force-enhanced connection of the awning material;

b) Can interlock with the u-shaped foot-toe connectors, to create a secure gravitational-force-enhanced connection of the table material;

c) Can interlock with the u-shaped foot-toe connectors, to create a secure gravitational-force-enhanced connection of the shelving material; and d) Can securely interlock the u-shaped foot-toe connectors, to overcome typical horizontal forces from wind and operational movement.

7) It is yet another object of the new invention to provide a unique 11-device-in-one system, having U-shaped foot-toe connectors and L-shaped telescopic-arm joints.

Therefore, the unique 11-device-in-one system:

a) Can adapt an extendable collapsible frame system to a side panel and end panel, to become an open-air gazebo with roof only;

b) Can adapt an extendable collapsible frame system to a side panel and end panel, to become a three-walled gazebo;

c) Can adapt an extendable collapsible frame system to a side panel and end panel, to become a two-walled gazebo;

d) Can adapt an extendable collapsible frame system to a side panel and end panel, to become a single-walled gazebo for privacy; and e) Can adapt an extendable collapsible frame system to a side panel and end panel, to become a walk-through two-sided walled gazebo.

8) It is still yet another object of the new invention to provide a unique 11-device-in-one system, having U-shaped foot-toe connectors and L-shaped telescopic-arm joints.

Therefore, the unique 11-device-in-one system:

a) Can securely hang retail products, to be used as retail display;

b) Can securely hang retail products, to be used in place of shelving;

c) Can securely hang vegetation; to be used with greenhouse configuration; and d) Can securely hang lights, to be used as lighting display.

What is claimed is:

1. An eleven-device-in-one 360-degree-rotatable rollable portable lockable collapsible expandable carport comprising:

an extendable collapsible frame system, said extendable collapsible frame system having a frame top, a plurality of frame sides, and a plurality of frame ends, said extendable collapsible frame system comprising:

a plurality of round bars, a plurality of square bars, a plurality of bases respectively connecting said round bars and said square bars together, a plurality of wheel connectors respectively and rotatably inserted into said bases, and 360-degree-rotatable lockable wheels respectively and rotatably attached to said wheel connectors;

a connector system comprising:

a plurality of X-shaped round-bar connectors respectively connecting said round bars together, a plurality of T-shaped round-bar connectors respectively connecting said round bars together, a plurality of U-shaped square-bar connectors respectively connecting said round bars and said square bars together, and a plurality of bolts and nuts respectively securing said X-shaped round-bar connectors, said T-shaped round-bar connectors, and said U-shaped square bar connectors to said round bars and said square bars;

an adjustable foldable arm system comprising:

a plurality of first telescopic arms, a plurality of second telescopic arms, a plurality of U-shaped telescopic-arm connectors respectively connecting said first telescopic arms to said X-shaped round-bar connectors, a plurality of U-shaped foot-toe connectors respectively welded to said round bars, each of said U-shaped foot-toe connectors having at least one slot, a plurality of L-shaped telescopic-arm joints respectively and foldably connecting said first telescopic arms and said second telescopic arms together, a plurality of locking pins respectively inserted through said L-shaped telescopic-arm joints and said first telescopic arms for releasably locking said L-shaped telescopic-arm joints and said first telescopic arms in place, a plurality of U-shaped locking rings respectively snap-locked on said locking pins for releasably securing said locking pins to said L-shaped telescopic-arm joints, a plurality of feet respectively welded to said second telescopic arms, and a plurality of toes respectively welded to said feet, said toes for straddling said at least one slot for respectively securing said feet to said U-shaped foot-toe connectors;

a panel system comprising:

a plurality of roof panels for covering said frame top, a plurality of side panels for respectively covering said frame sides, a plurality of end panels for respectively covering said frame ends, a plurality of panel-sealing grommets respectively attached to said roof panels, said side panels, and said end panels, and a plurality of arm-securing ties respectively sewn on said side panels for respectively tying said first telescopic arms and said second telescopic arms to said side panels; and a bungee cord system comprising:

a plurality of bungee-cord-locking balls, and a plurality of panel-attaching bungee cords respectively tied to said bungee-cord-locking balls, said panel-attaching bungee cords inserted through said panel-sealing grommets and hooked on said bungee-cord-locking balls for respectively attaching said roof panels, said side panels, and said end panels together, and for respectively attaching said roof panels, said side panels, and said end panels to said round bars and said square bars, whereby said eleven-device-in-one 360-degree-rotatable rollable portable lockable collapsible expandable carport can function as:

a 360-degree-rotatable rollable portable lockable collapsible expandable carport, a 360-degree-rotatable rollable portable lockable collapsible expandable green house, a 360-degree-rotatable rollable portable lockable collapsible expandable gazebo, a 360-degree-rotatable rollable portable lockable collapsible expandable storage, a 360-degree-rotatable rollable portable lockable collapsible expandable attic, a 360-degree-rotatable rollable portable lockable collapsible expandable awning, a 360-degree-rotatable rollable portable lockable collapsible expandable tent, a 360-degree-rotatable rollable portable lockable collapsible expandable workshop, a 360-degree-rotatable rollable portable lockable collapsible expandable shelter, a 360-degree-rotatable rollable portable lockable collapsible expandable booth, and a 360-degree-rotatable rollable portable lockable collapsible expandable RV port.

2. The eleven-device-in-one 360-degree-rotatable rollable portable lockable collapsible expandable carport of claim 1, wherein said first telescopic arms and said second telescopic arms swing up over said roof panels, and said feet respectively attach to each other such that said first telescopic arms form a plurality of frames for holding advertising signs above said roof panels and said side panels.

3. The eleven-device-in-one 360-degree-rotatable rollable portable lockable collapsible expandable carport of claim 1, further comprising at least one transparent panels attached to said roof panels or said side panels for letting sun beams shine therethrough.

4. The eleven-device-in-one 360-degree-rotatable rollable portable lockable collapsible expandable carport of claim 1, further comprising two panel-sealing zippers, wherein one of said end panels has two slits thereon for defining a door therebetween, wherein said two panel-sealing zippers are respectively attached to said two slits for opening and closing said door.

5. The eleven-device-in-one 360-degree-rotatable rollable portable lockable collapsible expandable carport of claim 4, further comprising a plurality of door-lifting hook and loop fasteners respectively attached to said one of said end panels for holding said door up.

6. The eleven-device-in-one 360-degree-rotatable rollable portable lockable collapsible expandable carport of claim 1, further comprising a plurality of panel-sealing hook and loop fasteners and a plurality of gap-covering panels, wherein said panel-sealing hook and loop fasteners are respectively attached to said gap-covering panels and at least one of said roof panels, said side panels, and said end panels, wherein said gap-covering panels are for respectively joining said roof panels, said side panels, and said end panels together.

7. The eleven-device-in-one 360-degree-rotatable rollable portable lockable collapsible expandable carport of claim 6, wherein said gap-covering panels, said roof panels, said side panels, and said end panels are made of canvas, nylon, or fabric.

8. The eleven-device-in-one 360-degree-rotatable rollable portable lockable collapsible expandable carport of claim 6, wherein said gap-covering panels, said roof panels, said side panels, and said end panels are made of waterproof material.

9. The eleven-device-in-one 360-degree-rotatable rollable portable lockable collapsible expandable carport of claim 1, further comprising at least one table top, wherein said toes of said feet are respectively hooked on said at least one slot of said U-shaped foot-toe connectors to secure said feet on said U-shaped foot-toe connectors and to secure said second telescopic arms in a horizontal position for allowing said at least one table top to lay on said second telescopic arms for serving as a table.

10. An eleven-device-in-one carport comprising:

an extendable collapsible frame system, said extendable collapsible frame system having a frame top, a plurality of frame sides, and a plurality of frame ends, said extendable collapsible frame system comprising:

a plurality of round bars, a plurality of square bars, a plurality of bases respectively connecting said round bars and said square bars together, a plurality of wheel connectors respectively and rotatably inserted into said bases, and 360-degree-rotatable lockable wheels respectively and rotatably attached to said wheel connectors;

a connector system comprising:

a plurality of X-shaped bar connectors respectively connecting said round bars together, a plurality of T-shaped bar connectors respectively connecting said round bars together, a plurality of U-shaped bar connectors respectively connecting said round bars and said square bars together, and a plurality of bolts and nuts respectively securing said X-shaped bar connectors, said T-shaped bar connectors, and said U-shaped bar connectors to said round bars and said square bars;

an adjustable foldable arm system comprising:

a plurality of first telescopic arms, a plurality of second telescopic arms, a plurality of U-shaped arm connectors respectively connecting said first telescopic arms to said X-shaped bar connectors, a plurality of U-shaped toe connectors respectively welded to said round bars, each of said U-shaped toe connectors having at least one slot, a plurality of L-shaped arm joints respectively and foldably connecting said first telescopic arms and said second telescopic arms together, a plurality of locking pins respectively inserted through said L-shaped arm joints and said first telescopic arms for releasably locking said L-shaped arm joints and said first telescopic arms in place, a plurality of U-shaped locking rings respectively snap-locked on said locking pins for releasably securing said locking pins to said L-shaped arm joints, a plurality of feet respectively welded to said second telescopic arms, and a plurality of toes respectively welded to said feet, said toes for straddling said at least one slot for respectively securing said feet to said U-shaped toe connectors;

a panel system comprising:

a plurality of roof panels for covering said frame top, a plurality of side panels for respectively covering said frame sides, a plurality of end panels for respectively covering said frame ends, a plurality of grommets respectively attached to said roof panels, said side panels, and said end panels, and a plurality of ties respectively sewn on said side panels for respectively tying said first telescopic arms and said second telescopic arms to said side panels; and a bungee cord system comprising:

a plurality of locking balls, and a plurality of bungee cords respectively tied to said locking balls, said bungee cords inserted through said grommets and hooked on said locking balls for respectively attaching said roof panels, said side panels, and said end panels together, and for respectively attaching said roof panels, said side panels, and said end panels to said round bars and said square bars.

11. The eleven-device-in-one carport of claim 10, wherein said first telescopic arms and said second telescopic arms swing up over said roof panels, and said feet respectively attach to each other such that said first telescopic arms form a plurality of frames for holding advertising signs above said roof panels and said side panels.

12. The eleven-device-in-one carport of claim 10, further comprising at least one transparent panels attached to said roof panels or said side panels for letting sun beams shine therethrough.

13. The eleven-device-in-one carport of claim 10, further comprising two zippers, wherein one of said end panels has two slits thereon for defining a door therebetween, wherein said two zippers are respectively attached to said two slits for opening and closing said door.

14. The eleven-device-in-one carport of claim 13, further comprising a plurality of hook and loop fasteners respectively attached to said one of said end panels for holding said door up.

15. The eleven-device-in-one carport of claim 10, further comprising a plurality of hook and loop fasteners and a plurality of gap-covering panels, wherein said hook and loop fasteners are respectively attached to said gap-covering panels and at least one of said roof panels, said side panels, and said end panels, wherein said gap-covering panels are for respectively joining said roof panels, said side panels, and said end panels together.

16. The eleven-device-in-one carport of claim 15, wherein said gap-covering panels, said roof panels, said side panels, and said end panels are made of canvas, nylon, or fabric.

17. The eleven-device-in-one carport of claim 15, wherein said gap-covering panels, said roof panels, said side panels, and said end panels are made of waterproof material.

18. The eleven-device-in-one carport of claim 10, further comprising at least one table top, wherein said toes of said feet are respectively hooked on said at least one slot of said U-shaped toe connectors to secure said feet on said U-shaped toe connectors and to secure said second telescopic arms in a horizontal position for allowing said at least one table top to lay on said second telescopic arms for serving as a table.

19. An eleven-device-in-one carport comprising:

a frame system, said frame system having a frame top, a plurality of frame sides, and a plurality of frame ends, said frame system comprising:

a plurality of round bars, a plurality of square bars, a plurality of bases respectively connecting said round bars and said square bars together, a plurality of wheel connectors respectively and rotatably inserted into said bases, and 360-degree-rotatable lockable wheels respectively and rotatably attached to said wheel connectors;

a connector system comprising:

a plurality of X-shaped bar connectors respectively connecting said round bars together, a plurality of T-shaped bar connectors respectively connecting said round bars together, a plurality of U-shaped bar connectors respectively connecting said round bars and said square bars together, and a plurality of bolts and nuts respectively securing said X-shaped bar connectors, said T-shaped bar connectors, and said U-shaped bar connectors to said round bars and said square bars;

an adjustable foldable arm system comprising:

a plurality of first telescopic arms, a plurality of second telescopic arms respectively and foldably connected to said first telescopic arms, a plurality of U-shaped arm connectors respectively attached to said X-shaped bar connectors for respectively connecting said first telescopic arms to said X-shaped bar connectors, a plurality of feet respectively welded to said second telescopic arms;

a panel system comprising:

a plurality of roof panels for covering said frame top, a plurality of side panels for respectively covering said frame sides, a plurality of end panels for respectively covering said frame ends, a plurality of grommets respectively attached to said roof panels, said side panels, and said end panels, and a plurality of ties respectively sewn on said side panels for respectively tying said first telescopic arms and said second telescopic arms to said side panels; and a bungee cord system comprising:

a plurality of locking balls, and a plurality of bungee cords respectively tied to said locking balls, said bungee cords inserted through said grommets and hooked on said locking balls for respectively attaching said roof panels, said side panels, and said end panels together, and for respectively attaching said roof panels, said side panels, and said end panels to said round bars and said square bars.

20. The eleven-device-in-one carport of claim 19, wherein said first telescopic arms and said second telescopic arms swing up over said roof panels, and said feet respectively attach to each other such that said first telescopic arms form a plurality of frames for holding advertising signs above said roof panels and said side panels.

* * * * *